US010499693B2

(12) United States Patent
Chin et al.

(10) Patent No.: US 10,499,693 B2
(45) Date of Patent: Dec. 10, 2019

(54) SELECTIVELY STIFFENABLE ASSEMBLIES, PROTECTIVE GARMENTS FOR PROTECTING AN INDIVIDUAL, AND SYSTEMS AND METHODS OF USING THE SAME

(71) Applicant: Elwha LLC, Bellevue, WA (US)

(72) Inventors: Hon Wah Chin, Palo Alto, CA (US); Elizabeth A. Sweeney, Seattle, WA (US); Alistair K. Chan, Bainbridge Island, WA (US); Jordin T. Kare, San Jose, CA (US)

(73) Assignee: ELWHA LLC, Bellevue, WA (US)

( * ) Notice: Subject to any disclaimer, the term of this patent is extended or adjusted under 35 U.S.C. 154(b) by 419 days.

(21) Appl. No.: 15/184,094

(22) Filed: Jun. 16, 2016

(65) Prior Publication Data

US 2017/0360122 A1 Dec. 21, 2017

(51) Int. Cl.
*A41D 13/015* (2006.01)
*A41D 1/00* (2018.01)
(Continued)

(52) U.S. Cl.
CPC ..... *A41D 13/015* (2013.01); *A41D 1/002* (2013.01); *A41D 13/0518* (2013.01);
(Continued)

(58) Field of Classification Search
CPC .... A41D 13/015; A41D 1/002; A41D 31/005; A41D 13/0153; A41D 13/0156;
(Continued)

(56) References Cited

U.S. PATENT DOCUMENTS 3,563,836 A * 2/1971 Dunbar ..... F41H 5/0457 109/80
4,179,979 A * 12/1979 Cook ..... F41H 5/0414 109/49.5

(Continued)

OTHER PUBLICATIONS

"File:Gyorin kozane scale armor.jpg", https/commons.wikimedia.org/wiki/File:Gyorin_kozane_scale_armor.jpg; accessed Feb. 23, 2016, published Jan. 4, 2015.

(Continued)

*Primary Examiner* — Alissa J Tompkins
*Assistant Examiner* — F Griffin Hall
(74) *Attorney, Agent, or Firm* — Dorsey & Whitney LLP

(57) ABSTRACT

Embodiments disclosed herein are directed to selectively stiffenable assemblies, protective garments and systems that include such selectively stiffenable assemblies for protecting one or more body portions of an individual wearing the protective garment, and methods of protecting a subject from an impact with a protective garment worn by the subject. A protective may include a plurality of first shield segments forming a first arrangement, a plurality of second shield segments laterally offset from the plurality of first shield segments and forming a second arrangement, and a compression mechanism operably coupled to the plurality of first shield segments and to the plurality of second shield segments and configured to compress together at least one of the plurality of first shield segments and at least one of the plurality of second shield segments.

50 Claims, 15 Drawing Sheets

(51) Int. Cl.

| | |
|---|---|
| ***A41D 13/05*** | (2006.01) |
| ***F41H 1/02*** | (2006.01) |
| ***F41H 5/007*** | (2006.01) |
| ***F41H 5/04*** | (2006.01) |
| ***A41D 31/28*** | (2019.01) |

(52) U.S. Cl.
CPC ..... *A41D 31/285* (2019.02); *F41H 1/02* (2013.01); *F41H 5/007* (2013.01); *F41H 5/0492* (2013.01)

(58) Field of Classification Search
CPC ..... A41D 13/0002; A41D 31/0005; A41D 31/31; A41D 31/0044; A41D 31/0055; A41D 31/0066; A41D 31/0011; A41D 31/0016; A41D 31/0022; A41D 31/0027; A41D 31/0033; A41D 31/0038; A41D 31/0061; A41D 31/02; F41H 5/007; F41H 1/02; F41H 1/00; F41H 5/04; F41H 5/0492; Y10T 428/17
USPC ..... 2/455
See application file for complete search history.

(56) References Cited

U.S. PATENT DOCUMENTS 4,633,756 A * 1/1987 Rudoi ..... F41H 5/0435 2/2.5
4,951,689 A * 8/1990 Jones ..... A61B 42/10 2/160
5,364,679 A * 11/1994 Groves ..... B32B 3/10 428/76
5,515,541 A * 5/1996 Sacks ..... A41D 31/0061 2/2.5
5,601,895 A * 2/1997 Cunningham ..... A41D 31/0061 428/66.6
5,738,925 A * 4/1998 Chaput ..... B32B 3/10 428/101
6,170,378 B1 * 1/2001 Neal ..... F41H 5/0492 156/256
6,510,777 B2 * 1/2003 Neal ..... B32B 3/06 2/2.5
6,745,661 B1 * 6/2004 Neal ..... B32B 3/06 89/36.02
7,472,637 B2 1/2009 Sarva et al.
8,028,612 B2 * 10/2011 Neal ..... F41H 5/0407 89/36.01
8,490,213 B2 * 7/2013 Neal ..... A41D 31/005 2/2.5
9,226,707 B2 * 1/2016 Huang ..... A42B 3/0473
9,347,746 B1 * 5/2016 Andrews ..... F41H 5/0492
2006/0249012 A1 11/2006 Sarva et al.
2009/0165193 A1 7/2009 Michel et al.
2011/0059291 A1 3/2011 Boyce et al.
2012/0079647 A1 4/2012 Doherty et al.
2012/0174302 A1 * 7/2012 Jenkins, III ..... A41D 13/0531 2/468
2015/0297973 A1 * 10/2015 Beers ..... A63B 71/12 2/461

OTHER PUBLICATIONS

Rettner, Rachel , "Tough Snail Shell Could Inspire Better Body Armor", http://www.livescience.com/8017-tough-snail-shell-inspire-body-armor.html; accessed Feb. 23, 2016, published Jan. 18, 2010, 1-4.
Sofge, Eric , "Mega Fish Scales Inspire Future of Body Armor at MIT", http://www.popularmechanics.com/science/a12086/4275401, accessed Feb. 23, 2016, 1-4.

* cited by examiner

SELECTIVELY STIFFENABLE ASSEMBLIES, PROTECTIVE GARMENTS FOR PROTECTING AN INDIVIDUAL, AND SYSTEMS AND METHODS OF USING THE SAME

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

PRIORITY APPLICATIONS

None.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

BACKGROUND

Impact injuries are sustained from impacts of objects against an individual and impact of the individual against objects. Impact injuries include blunt force traumas, punctures, concussion, broken bones, damaged joints, and other medical conditions. Equipment for prevention of impact injuries has existed for many centuries in many forms, including medieval armor and ancient Egyptian helmets.

Prevention of impact injuries has led to the development of modern safety equipment, such as hardhats, batting helmets, football pads, knee-braces, and body armor such as bullet proof vests, etc. Some safety equipment useful for preventing impact injuries is bulky, cumbersome, heavy, and can limit movement. For example, football pads can limit movement and tend to be bulky. Knee or other joint braces can unduly limit range of motion. Body armor tends to be bulky, heavy, and may limit range of motion in some cases.

SUMMARY

Embodiments disclosed herein are directed to selectively stiffenable assemblies, protective garments and systems that include such selectively stiffenable assemblies for protecting one or more body portions of an individual wearing the protective garment. For example, selectively stiffenable assemblies, protective garments, and systems can be reconfigured from a first, undeployed configuration to a second, deployed configuration (e.g., in the deployed configuration, the protective garments and systems can be configured to protect the individual from impact). In an embodiment, the protective garment can be more flexible in the undeployed configuration than in the deployed configuration.

In an embodiment, a protective garment is disclosed. The protective garment includes a plurality of first shield segments forming a first arrangement and a plurality of second shield segments laterally offset from the plurality of first shield segments and forming a second arrangement. At least one of the plurality of second shield segments is positioned adjacent to at least one of the plurality of first shield segments, and two or more shield segments of the plurality of first shield segments overlap the at least one of the plurality of second shield segments. The protective garment further includes a compression mechanism operably coupled to the plurality of first shield segments and to the plurality of second shield segments and configured to compress together at least one of the plurality of first shield segments and at least one of the plurality of second shield segments.

In an embodiment, a protective garment system is disclosed. The protective garment system includes a plurality of first shield segments forming a first arrangement and a plurality of second shield segments forming a second arrangement. At least one of the plurality of second shield segments positioned adjacent to at least one of the plurality of first shield segments, and two or more shield segments of the plurality of first shield segments overlap the at least one of the plurality of second shield segments. The protective garment system further includes a compression mechanism operably coupled to or integrated with at least one of the plurality of first shield segments or with the plurality of second shield segments and configured to change sliding resistance therebetween from a first state to a second state. The sliding resistance between the plurality of first shield segments and the plurality of second shield segments is greater in the second state.

An embodiment includes a method of protecting a subject from an impact with a protective garment worn by the subject. The protective garment includes a plurality of first shield segments forming a first arrangement; a plurality of second shield segments laterally offset from the plurality of first shield segments and forming a second arrangement, at least one of the plurality of second shield segments positioned adjacent to at least one of the plurality of first shield segments and two or more shield segments of the plurality of first shield segments overlapping the at least one of the plurality of second shield segments; and a compression mechanism operably coupled to the plurality of first shield segments and to the plurality of second shield segments. The method includes via the compression mechanism, compressing together at least one of the plurality of first shield segments and at least one of the plurality of second shield segments.

In an embodiment a selectively stiffenable assembly is disclosed. The selectively stiffenable assembly includes a plurality of first shield segments forming a first arrangement and a plurality of second shield segments laterally offset from the plurality of first shield segments and forming a second arrangement. At least one of the plurality of second shield segments positioned adjacent to at least one of the plurality of first shield segments, and two or more shield segments of the plurality of first shield segments overlap the at least one of the plurality of second shield segments. The selectively stiffenable assembly further includes a compression mechanism operably coupled to the plurality of first shield segments and to the plurality of second shield segments and configured to compress together at least one of the plurality of first shield segments and at least one of the plurality of second shield segments.

Features from any of the disclosed embodiments can be used in combination with one another, without limitation. In addition, other features and advantages of the present disclosure will become apparent to those of ordinary skill in the art through consideration of the following detailed description and the accompanying drawings.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1A:
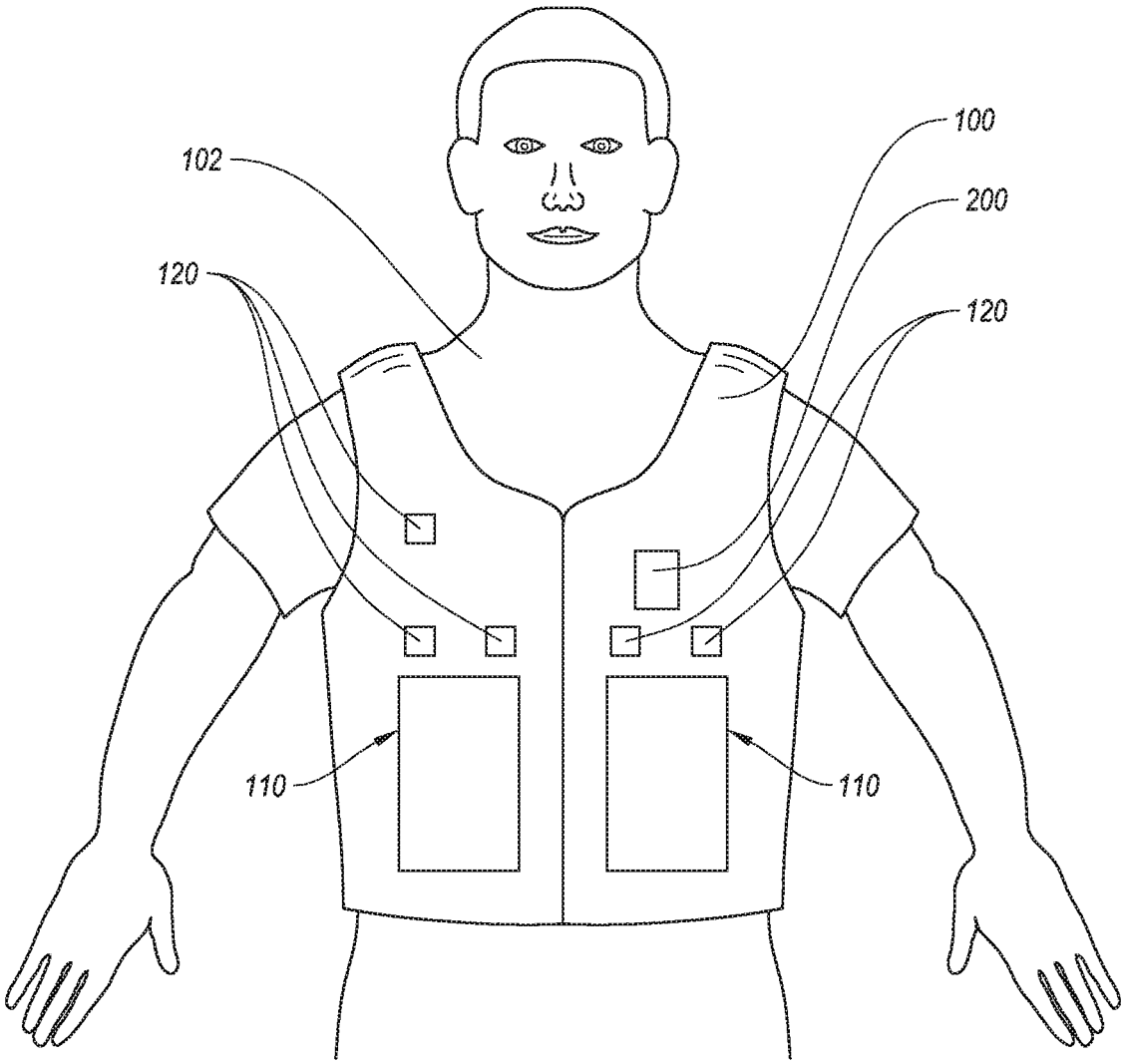
FIG. 1A is a schematic illustration of an individual wearing a protective garment, according to an embodiment.

Embodiments disclosed herein are directed to selectively stiffenable assemblies, protective garments, and systems that include such selectively stiffenable assemblies for protecting one or more body portions of an individual wearing the protective garment. For example, selectively stiffenable assemblies, protective garments, and systems can be reconfigured from a first, undeployed configuration to a second, deployed configuration (e.g., in the deployed configuration, the protective garments and systems can be configured to protect the individual from an impact). In an embodiment, the protective garment can be more flexible in the undeployed configuration than in the deployed configuration.

In an embodiment, the individual wearing the protective garment can have a substantially full range of motion of the various body portions covered or protected by the protective garment. For example, in the undeployed configuration, the protective garment can bend, twist, or otherwise deform as the individual moves or bends the body portions protected or covered by the protective garment. Moreover, in an embodiment, the protective garment can be shaped or contoured to the shape(s) of the body portions of the individual. For example, an inside side or surface of the protective garment can be at least partially or substantially in contact with the skin of the individual or can generally follow the contours of the surface of the skin of the individual.

In an embodiment, the selectively stiffenable assembly can include multiple first shield segments arranged to form a first arrangement and multiple second shield segments arranged to form a second arrangement. At least one of each of the first and second shield segments can be positioned adjacent to each other such that a compression mechanism can compress together the first shield segment(s) and the second segment(s). For example, the first arrangement can be positioned over the second arrangement, and the compression mechanism can compress together the first and second shield segments. In an embodiment, compressing together the first and second shield segments can reduce relative movement or sliding thereof. For example, as the sliding of the first shield segments relative to the second shield segments is inhibited or prevented, the selectively stiffenable assembly can exhibit a greater stiffness as compared to the stiffness thereof when the first and second shield segments can move or slide relative to each other relatively freely. Hence, for example, the stiffness of the selectively stiffenable assembly can be adjusted (e.g., between stiff and flexible settings or on continuous stiffness/flexibility scale) by adjusting relative sliding resistance between the shield segments.

Generally, the shield segments can include any number of suitable materials. In an embodiment, the shield segments can include a suitably rigid or resilient material (e.g., plastic, metal, etc.) that can suitably absorb and redistribute impact force (e.g., without plastic deformation or failure), such as to reduce pressure experienced by the individual from the impact (e.g., to reduce the force transferred to the individual at the location of the impact). Moreover, multiple shield segments can connect or interconnect together, such as to form one or more layers of shield segments. For example, the compression mechanism can compress together the layers of the shield segments to increase the stiffness of the selectively stiffenable assembly.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments can be utilized, and other changes can be made, without departing from the spirit or scope of the subject matter presented here.

FIG. 1A is a schematic illustration of a system for protecting an individual 102 from injuries such as impacts, puncture wounds, concussion, etc., according to an embodiment. The system includes at least one protective member or selectively stiffenable assembly 110, one or more sensors 120, and at least one controller 200. At least one of the one or more selectively stiffenable assemblies 110, one or more sensors 120, and at least one controller 200 can be supported by or integrated into a protective garment 100.

The protective garment 100 can be worn by the individual 102. Generally, the protective garment can be worn by the individual 102 on any body portion thereof for protection from impact. In the illustrated embodiment, the protective garment 100 can at least partially surround the torso of the individual 102. In an embodiment, the protective garment 100 can protect at least a portion of the torso and one or more internal organs of the individual 102 from an impact (e.g., spleen, kidneys, liver, etc.).

The protective garment 100 can change from a first state (e.g., an undeployed configuration) to a second state (e.g., deployed configuration) responsive to one or more control signals or instructions from the at least one controller 200. In the first state, the selectively stiffenable assemblies 110 can be configured or arranged to provide flexibility or freedom of movement to one or more body parts of the individual (e.g., leg, abdomen, etc.) or a portion of the protective garment 100 (e.g., sleeve, waist, abdominal region, etc.) adjacent thereto, than in the second state (e.g., in deployed configuration). In the second state or deployed configuration, the selectively stiffenable assemblies 110 can be configured or arranged to provide relative inflexibility or increased stiffness (as compared to the first state or undeployed configuration) to thereby protect one or more body parts of the individual 102 from injuries. The relative rigidity or stiffness of the second state or deployed configuration can provide one or more of impact resistance, structural support, or force-dampening effects to a body part of the individual 102 or to the protective garment 100, such as to reduce pressure experienced by the individual from the impact (e.g., to reduce the force transferred to the individual at the location of the impact).

The one or more sensors 120 can sense at least one of a potential impact or an actual impact, as described in detail below. The sensed potential impact or actual impact can be relayed from the one or more sensors 120 to the controller 200. The controller 200 is configured to selectively direct one or more of the selectively stiffenable assemblies 110 to alter from the first state to the second state, vice versa, or some intermediate state therebetween, responsive to the sensed impact or potential impact, as described in more detail below.

Alternatively or additionally, in an embodiment, the controller 200 can receive input from one or more sensors, such as sensors 120. For example, the sensors 120 can be operably coupled to control electrical circuitry of the controller 200 (e.g., at the I/O interface of the controller 200). In an embodiment, at least one sensor (e.g., at least one sensor 120) can be positioned on, positioned near, or integrated with one or more portions of the protective garment 100.

Suitable sensors (e.g., sensors 120) can vary from one embodiment to the next. For example, the sensors 120 can be configured to sense at least one of a potential or actual impact. Sensors can include, for example, one or more of accelerometers, proximity sensors, optical sensors, topography sensors, thermal sensors, force sensors, acoustic sensors, among others. For example, the potential impact source or actual impact source can be another individual, another athlete (e.g., a football player), a projectile (e.g., a ball, falling debris), a surface (e.g., a road, a playing surface), etc.

In an embodiment, the sensors 120 can include one or more accelerometers configured to sense the movement of the individual, the potential impact source, or the actual impact source. In an embodiment, the sensors 120 can include one or more proximity sensors configured to sense one or more characteristics of the individual, the potential impact source, or the actual impact source. The one or more proximity sensors can include an infrared sensor, sonar, laser rangefinder, micro-impulse radar, inductive sensor, capacitive sensor, photoelectric sensor, ultrasonic sensor, etc. In an embodiment, the sensors can include one or more optical sensors configured to sense one or more characteristics of the individual, the potential impact source, or the actual impact source. The one or more optical sensors can include an active-pixel sensor, light-emitting diodes that are revised biased, a transducer, etc. In an embodiment, the sensors 120 can include one or more topography sensors configured to sense the radius of curvature of the potential impact source of the actual impact source. In an embodiment, the one or more sensors can include a thermal sensor configured to sense one or more characteristics of the individual, the potential impact source, or the actual impact source. In an embodiment, the sensors can include a force sensor configured to sense one or more characteristics of the actual impact. The force sensor can include a pressure sensor, a transducer, a displacement sensor, an impact sensor, a strain sensor, etc. In an embodiment, the sensors 120 can include one or more acoustic sensors configured to sense one or more characteristics of the individual, the potential impact source, or the actual impact source. In an embodiment, the sensors 120 can include an inertia sensor (e.g., MEMS inertia sensor) configured to sense movement of the individual. In an embodiment, the sensors 120 can include a heart rate monitor configured to sense the heart rate of the individual. In an embodiment, the sensors 120 can include a moisture sensor configured to sense sweat, blood, other body fluids, or other fluids.

The sensors 120 can be configured to sense one or more of direction of travel of at least a portion of the individual, velocity of at least a portion of the individual, acceleration of the individual, deceleration of at least a portion of the individual, a pressure applied to a portion of the individual or sensors on the protective garment worn by the individual by an object, a radius of curvature of the object contacting the protective garment system, a predicted force (e.g., tension, stress, strain, etc.) on a body part of the individual, or a direction of likely impact to at least one body part of the individual.

It should be also appreciated that, additionally or alternatively, one or more sensors can be positioned remotely from the individual 102. For example, sensors 120 can include cameras, thermal imaging devices, etc., that can sense an actual or impending impact. Such remote sensors can send one or more signals to the controller 200, and the controller 200 can control or direct operation of the stiffness of the selectively stiffenable assemblies 110 at least partially responsive to or based on the signals received from the sensor(s).

In an embodiment, the controller 200 can receive one or more inputs that the controller 200 can correlate to an impact or impending impact onto the protective garment 100 and the individual 102 wearing the protective garment 100. In an embodiment, as described below in more detail, the controller 200 can receive one or more inputs via the interface. For example, the interface of the controller 200 can be operably coupled to or integrated with control electrical circuitry of the controller 200 and can receive one or more inputs directly from the individual wearing the protective garment 100 or from other individuals (e.g., observers, such as coaches, trainers, medical staff, etc.).

In an embodiment, the individual 102 can send or input one or more inputs into the controller 200, which can be correlated by the controller 200 to an impact or an impending impact, and responsive to which the controller 200 can generate one or more signals that can be sent to the activation mechanism of at least one of the selectively stiffenable assemblies 110, to reconfigure the stiffenable assemblies 110 into the deployed configuration.

The input can be sent via any suitable input device (e.g., the controller 200 can include or can be connected to the interface configured to communicate with one or more of a user, a computer, a tablet, a cellular device, or a remote control). For example, a personal electronic device (e.g., personal electronic device of the individual 102, such as a smart phone) can be operably coupled at the interface of the controller 200 and can send one or more signals or inputs to the controller 200. Additionally or alternatively, one or more buttons, a keyboard, or any other suitable device can be operably coupled to the controller 200 (e.g., at the interface thereof) and can send one or more signals thereto. Such signals can be processed or correlated by the controller 200 to one or more signals to move one or more of the shield segments (e.g., to signals that can be sent to activation mechanism(s)).

In some embodiments, sensors can be included or incorporated in a device or system that can be carried by the user, which can operably connect to the controller 200. For example, the sensors can be included in a personal electronic device (e.g., smart phone, tablet, or other handheld device) that can be carried by the user. Furthermore, the input devices (e.g., sensor(s), personal electronic device(s), etc.) can couple or connect to the controller 200 in any number of suitable ways. For example, the input devices can have a wired or wireless connection with the controller 200. In an embodiment, the controller 200 can reconfigure or direct reconfiguration of the protective garment 100 between the unprotected and deployed configurations at least in part based on the input received at the controller 200 (e.g., based on signals received from one or more sensors, from the individual 102, from a third-party, combinations of the foregoing, etc.).

In an embodiment, the controller 200 can include memory or storage for storing data. For example, control electrical circuitry of the controller 200 can be configured to store data that includes the number of times one or more forces were applied to at least one of the selectively stiffenable assemblies 110. Additionally or alternatively, the controller 200 can store data related to the magnitude of the one or more forces applied to at least one of the selectively stiffenable assemblies 110. Furthermore, in an embodiment, the controller 200 can store data related to direction of the one or more forces applied to at least one of the selectively stiffenable assemblies 110. In an embodiment, the controller 200 can be configured to send at least some of the stored data to another device or system (e.g., to another control electrical circuitry, a handheld device, a personal computer, combinations thereof, etc.).

Generally, the protective garment 100 can include any number of selectively stiffenable assemblies 110 that can be positioned and oriented in any number of suitable configurations, which can vary from one embodiment to the next. For example, the selectively stiffenable assemblies 110 can be arranged such as to collectively cover any suitable or desirable body portion of the individual 102. Additionally or alternatively, any of the selectively stiffenable assemblies 110 can be sized and shaped to cover or protect any suitable body portion or multiple body portions of the individual 102, as may vary from one embodiment to the next.

Figure 1B:
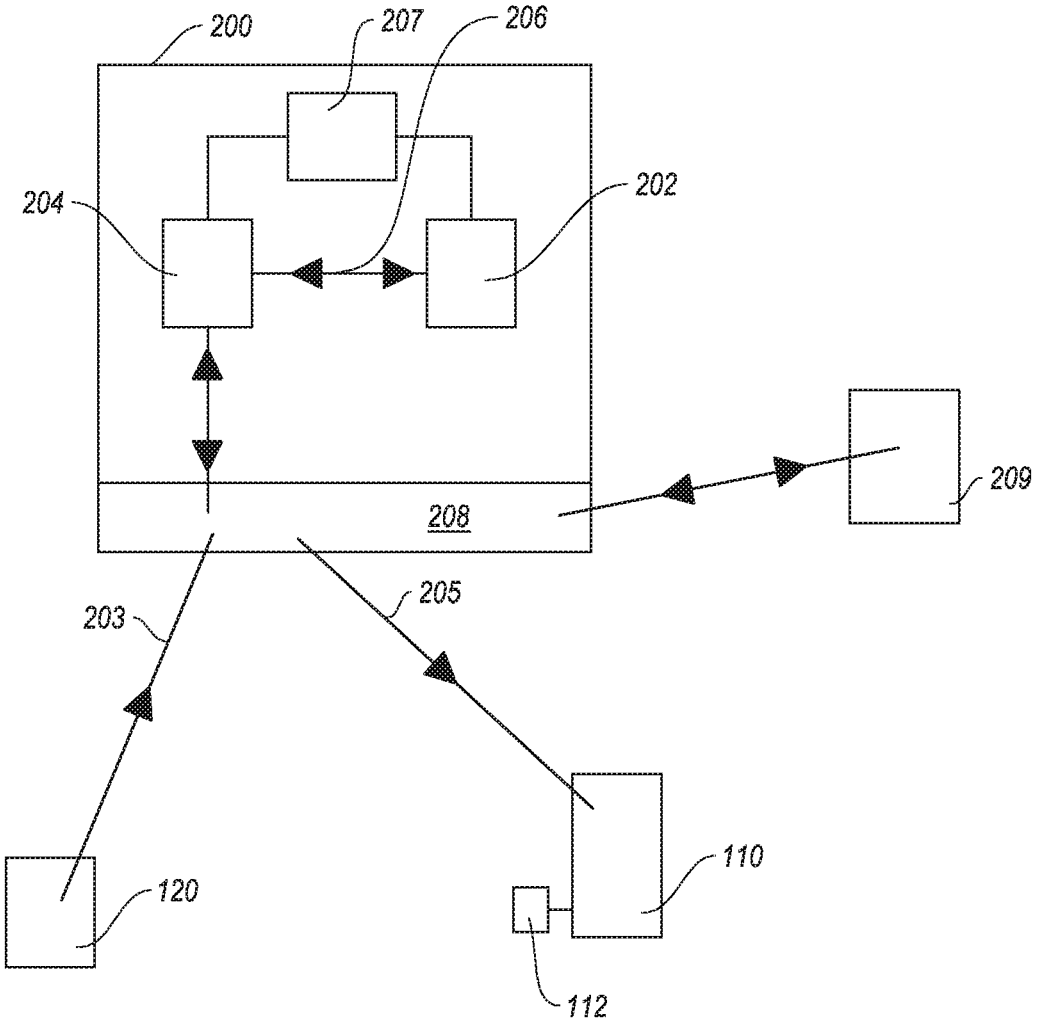
FIG. 1B is a block diagram of a protective garment system including a controller, according to an embodiment.

FIG. 1B is a block diagram of a protective garment system that includes at least one selectively stiffenable assembly 110, at least one sensor 120, and the controller 200, according to an embodiment. The controller 200 can include at least one memory storage medium 202 and at least one processor 204 including processing electrical circuitry operably coupled to the at least one memory storage medium 202. The controller can include an interface 208. The controller 200 can be configured to determine if a deployment condition is required for the protective garment 100 based at least partially on the one or more sensors 120 sensing at least one of a potential impact or an actual impact to the individual. The at least one controller 200 can be operably coupled to the activation mechanism(s) of the selectively stiffenable assembly 110 and to sensor(s) 120. The at least one controller 200 can control reconfiguring the selectively stiffenable assembly 110 from an undeployed configuration to a deployed configuration (and vice versa), as described herein. For example, the selectively stiffenable assembly 110 can include multiple selectively stiffenable layers, and the controller 200 can control increase or decrease of the stiffness of the selectively stiffenable layers to reconfigure the selectively stiffenable assembly 110 to the deployed configuration or to undeployed configuration. It should be appreciated that a system can include multiple selectively stiffenable assemblies 110 or multiple controllers 200. For example, a single controller can controller operation of multiple selectively stiffenable assemblies 110 (e.g., controlling reconfiguring of multiple selectively stiffenable assemblies 110 between deployed and undeployed configuration). Additionally or alternatively, multiple controllers 200 can control operation of a single selectively stiffenable assembly 110 or multiple selectively stiffenable assemblies 110.

As described below in more detail, the selectively stiffenable assemblies 110 can include or can be coupled to an actuator 112 (e.g., to a motor, pump, a fluid reservoir, etc.). In particular, for example, the actuator 112 can receive one or more control signals from the controller 200 and responsive to the control signals can reconfigure the selectively stiffenable assemblies 110 from undeployed to deployed configuration, and vice versa.

In an embodiment, the at least one controller 200 can include multiple controllers, each operably coupled to at least some of the one or more sensors 120. For example, a protective garment system can include a plurality of controllers, each operably coupled to one or more sensors 120 and selectively stiffenable assembly 110 or activation mechanisms thereof, and each can be configured to determine if a distinct region is experiencing at least one of an actual or potential impact. Responsive to the determination, each controller 200 can direct the selectively stiffenable assembly 110 in the distinct region to increase or decrease stiffness thereof. In an embodiment, each of the plurality of controllers can be configured to communicate with others controllers of the plurality of controllers.

The at least one memory storage medium 202 can include any non-transitory memory storage medium, such as a hard-disk drive, a solid state memory device, a flash drive, or the like. The at least one memory storage medium 202 can include one or more of program instructions for the processor 204, data from the one or more sensors 120 (e.g., present or previous sensed motion characteristics such as potential impacts, actual impacts, or forces associated therewith), threshold values for one or more forces or characteristics sensed by the one or more sensors 120, a history of the protective garment (e.g., deployment or inflation history of each inflatable member, current status of the protective garment system, etc.), look-up tables corresponding to any of the proceeding, or system diagnostic statuses (e.g., current and past statuses, or readiness states of any components of the system).

The at least one processor 204 can be operably coupled to the at least one memory storage medium 202 via the connection 206. The connection 206 can be a wireless connection or a hardwired connection. The at least one processor 204 is configured to access and read the memory storage medium 202. The at least one processor 204 is configured to receive sensor signals or data (e.g., preprocessed or converted signals, such as converted from analog to digital) indicating a potential or actual impact. The at least one processor 204 is configured to direct operation of the activation mechanism(s) to reconfigure the selectively stiffenable assembly 110 between deployed and undeployed configurations, as described herein.

The at least one processor 204 is configured to determine if a deployment (e.g., protection) condition is required by the one or more sensors 120. For example, the one or more sensors 120 can sense one or more objects within a specific proximity of the protective garments system (or individual wearing the same), and the processor 204 can determine if the proximity is below a threshold value for safety. In an embodiment, the one or more sensors 120 can sense a velocity of the one or more objects (e.g., the ground or a car) relative to the individual (or vice versa) or to one or more sensors 120, and determine if the velocity is indicative of a potential impact therewith. In an embodiment, the one or more sensors 120 can be configured to sense a force or pressure applied thereto, and responsive to the sensed force the processor 204 can be configured to determine if an actual or potential impact is taking place. For example, one or more sensors 120 can be configured to sense a pressure applied thereto, and the processor can determine if the pressure is indicative of a force capable of injuring an individual, such as by comparing the measured force to a threshold force stored in the memory. The threshold levels can be set for any condition, such as the amount of pressure applied or potentially applied thereto, size of object impacting or potentially impacting the garment system, velocity of object impacting or potentially impacting the garment system, orientation of one or more portions of the garments system such as twisting, falling, or bending, or combinations thereof. The threshold value can be set by the individual, a medical professional, a manufacturer, the controller, or other persons.

Generally, the one or more sensors 120 can be positioned at any number of suitable locations that can vary from one embodiment to the next. For example, at least some of the one or more sensors 120 can be associated with (e.g., coupled to or integrated with one or more elements or components of the selectively stiffenable assembly 110, such as coupled to or integrated with one or more shield segments of the selectively stiffenable assembly 110). In an embodiment, force or pressure applied to one or more of the shield segments of the selectively stiffenable assembly 110 can be detected by at least one of the one or more sensors 120.

Condition values beyond threshold levels or values indicate the need for deployment conditions. The processor 204 can compare the sensed conditions, such as velocity, pressure, proximity, etc., to one or more threshold values to determine that an actual or potential impact is taking place. Responsive to a sensed characteristic (e.g., force, pressure, velocity, proximity, etc.) being beyond the corresponding threshold value, the processor 204 can be configured to direct reconfiguration of the protective garment 100 from the undeployed configuration to the deployed configuration or vice versa. In an embodiment, the at least one processor 204 can be configured to determine if a potential impact or actual impact is taking place based on a combination of any of the sensed characteristics disclosed herein. Responsive to the determination of a required deployment condition (e.g., a change in status), the processor 204 can direct activation mechanism in a manner that reconfigures that selectively stiffenable assembly 110 into the deployed configuration.

The processor 204 can be configured to determine if a threshold level has been met or exceeded by a differential of one or more sensed characteristics sensed at adjacent sensors of the one or more sensors 120. For example, only a single sensor 120 of a plurality of sensors 120 indicating a specific amount of pressure in a specific region of a garment can indicate a puncture wound is likely as compared to the same pressure spread out over a larger surface area. Responsive thereto, the processor 204 can direct the selectively stiffenable assembly 110 to reconfigure from undeployed configuration to deployed configuration. In an embodiment, a threshold level can include a level of pressure applied over a surface area whereby the threshold level corresponds to a force indicative of a possible puncture that would result from a relatively sharp object. In an embodiment, from sensor data from the plurality of sensors 120, the processor 204 can be configured to determine a level of acceleration or deceleration indicative of a force capable of breaking bone of the individual, or a motion and directions thereof (e.g., twisting or bending) indicative of a force capable of damaging a body part of the individual. Suitable threshold levels can be stored in the memory storage medium 202.

The processor 204 can be configured to set or adjust one or more threshold levels based on one or more of a velocity of at least one body part of the individual, one or more physiological attributes of the individual (e.g., weight, height, age, health, etc.), a location of the individual within an area (e.g., if the individual is within a playing field), a location of the individual with respect to one or more objects, a time of day, an elapsed time (e.g., has the individual been playing for a pre-determined amount of time), a history of impacts, a history of deployment, a velocity of the individual (e.g., how fast is a football player running), or an activity level of the individual. That is, the processor 204 can be configured to adjust the threshold levels to compensate for velocity of a person, size of a person wearing the protective garment system, proximity of the individual to adjacent objects, or any other criteria.

In an embodiment, the processor 204 can be configured to search the deployment history of the selectively stiffenable assemblies and at least partially base deployment determinations thereon. For example, the processor 204 can note a region where multiple impacts have taken place (as determined from multiple deployments) and stiffen the selectively stiffenable assembly 110 therein to provide added protection from repetitive injury to the individual in that region.

As discussed above, the controller 200 can include the interface 208. The interface 208 can be configured to communicate with one or more of a user, a computer, a tablet, a cellular device, or a remote control. The interface 208 can include a screen, an input device, transceiver, or relay. For example, the interface 208 can relay sensed information signals 203 from the sensors 120 to the processor 204 or memory storage medium 202, and can relay control signals 205 to the selectively stiffenable assembly 110. In an embodiment, the sensed information signals 203 and control signals 205 can be relayed directly between the processor 204 and sensors 120 or between the processor and the selectively stiffenable assembly 110. The sensed information or signals 203 and 205 can be transmitted and received via a wireless connection (e.g., Wi-Fi, infrared, Bluetooth, etc.) or a hardwired connection.

In an embodiment, the interface 208 can include or can be connected to a user interface 209 configured to inform a user or the individual, information relating to the system. The user interface 209 can include one or more output devices such as a screen, chime, or haptic indicator and one or more input devices (such as a keyboard, buttons, levers, switches, dials, voice input devices, such as microphone, etc.). The user interface 209 can include a desktop computer, a laptop computer, a tablet computer, a cellular device (e.g., smart phone), a watch, or a remote control. The user interface 209 can be configured to output information to the user and accept input from the user. For example, the user interface 209 can be configured to output or communicate to a user (e.g., individual wearing a protective garment that includes at least one selectively stiffenable assembly 110, medical professional, coach, etc.) one or more of previous impacts against the individual, a deployment history of the selectively stiffenable assembly 110, sensed motion characteristics, a readiness status of one or more portions of the protective garment system, program instructions, or threshold levels of force applied to the individual. The interface 208 and user interface 209 can be configured to receive one or more of input, instructions, or programming from one or more of the individual, the user, a cellular device, a tablet, or a computer device.

The controller 200 can include a power source 207. The power source 207 can be operably coupled to (e.g., hardwired or wirelessly) one or more of the processor 204, the memory storage medium 202, the interface (including or excluding the user interface), the one or more sensors 120, the plurality of inflatable members, or the fluid source. The power source 207 can include one or more of a battery, a solar cell, a kinetic energy harvester, or a wall plug.

In an embodiment, any of the controllers or sensors can transmit information or data to one or more data storage devices or systems that can be associated with or can include medical records (e.g., medical records of the individual wearing the protective garment(s)). For example, the controller can store or transmit data related to the number and severity of impacts received by an individual (e.g., impact force imparted onto the individual, impact energy absorbed by the individual, location(s) of impact(s), etc.). In an embodiment, the medical records of the individual can be associated with or can receive information related to the impact(s) to assess effects of the impact(s) on the health of the individual, to assess whether the individual can need to seek medical attention, to assess whether the individual should be removed from a playing field, etc.

Generally, the selectively stiffenable assembly 110 can include two or more stiffenable layers that can be selectively stiffened (e.g., by compressing the stiffenable layers together, by increasing sliding resistance therebetween, etc.). It should be appreciated that, unless otherwise specifically stated, the terms "layer" or "layers" are not intended to connote or describe continuous elements—as used here, layers can include one or more elements or components, can be continuous or discontinuous, and the element(s) or component(s) of a layer can be located along a plane or along one or more reference or imaginary surfaces. Moreover, the sliding resistance between stiffenable layers can be adjusted by adjusting surface roughness of one or more of the stiffenable layers (e.g., increasing sliding resistance by increasing the surface roughness or height of protrusions and decreasing sliding resistance by decreasing the surface roughness or height of protrusions).

As described above, the controller can direct the selectively stiffenable assembly 110 to reconfigure from the undeployed configuration to the deployed configuration. Hence, for example, the controller can operate or direct operation of one or more compression mechanisms to compress together multiple stiffenable layers. In an embodiment, when the selectively stiffenable assembly 110 is in the undeployed configuration, the stiffenable layers can be configured to bend, fold, or otherwise deform. For example, when the selectively stiffenable assembly 110 is in the undeployed configuration, the stiffenable layers can be generally flexible or conformable to the body contours of the individual (e.g., body portions protected or covered by the selectively stiffenable assembly). It should be appreciated that the selectively stiffenable assembly 110 can bend or deform along multiple axes, such as to conform to the three-dimensional shapes or surfaces of the individual.

In an embodiment, when the selectively stiffenable assembly 110 bends or otherwise conforms to the body of the individual 102 (FIG. 1A), the two or more stiffenable layers or portions thereof can move or slide relative to each other. Relative movement or sliding of the stiffenable layers can facilitate bending and/or deformation of the stiffenable layers. For example, each of the stiffenable layers can include multiple shield segments, such that shield segments in a first stiffenable layer can pivot, tilt, bend, and move or slide relative to the shield segments in a second stiffenable layer.

Figure 2A:
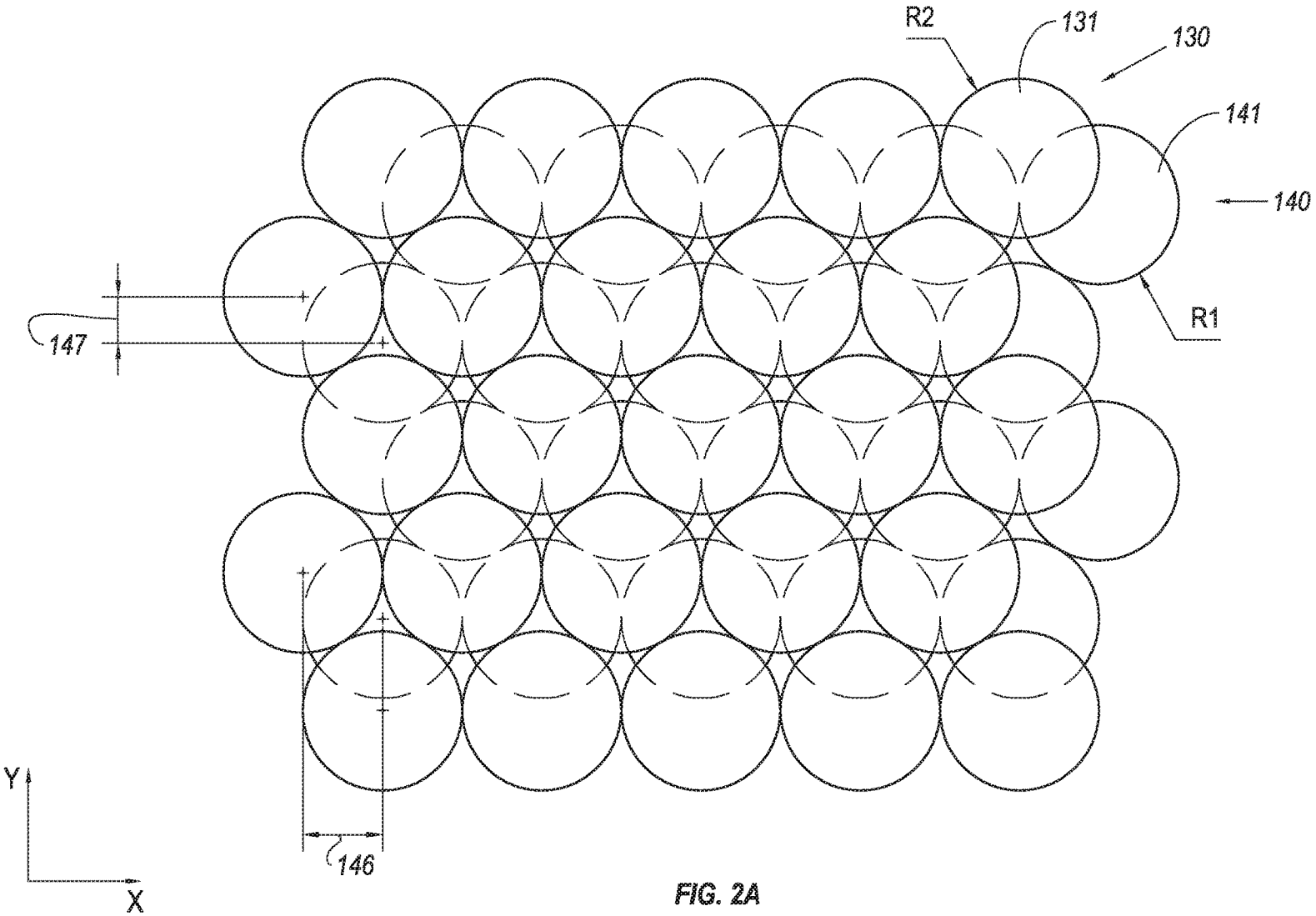
FIG. 2A is a schematic top plan view of selectively stiffenable layers, according to an embodiment.
Figure 2B:
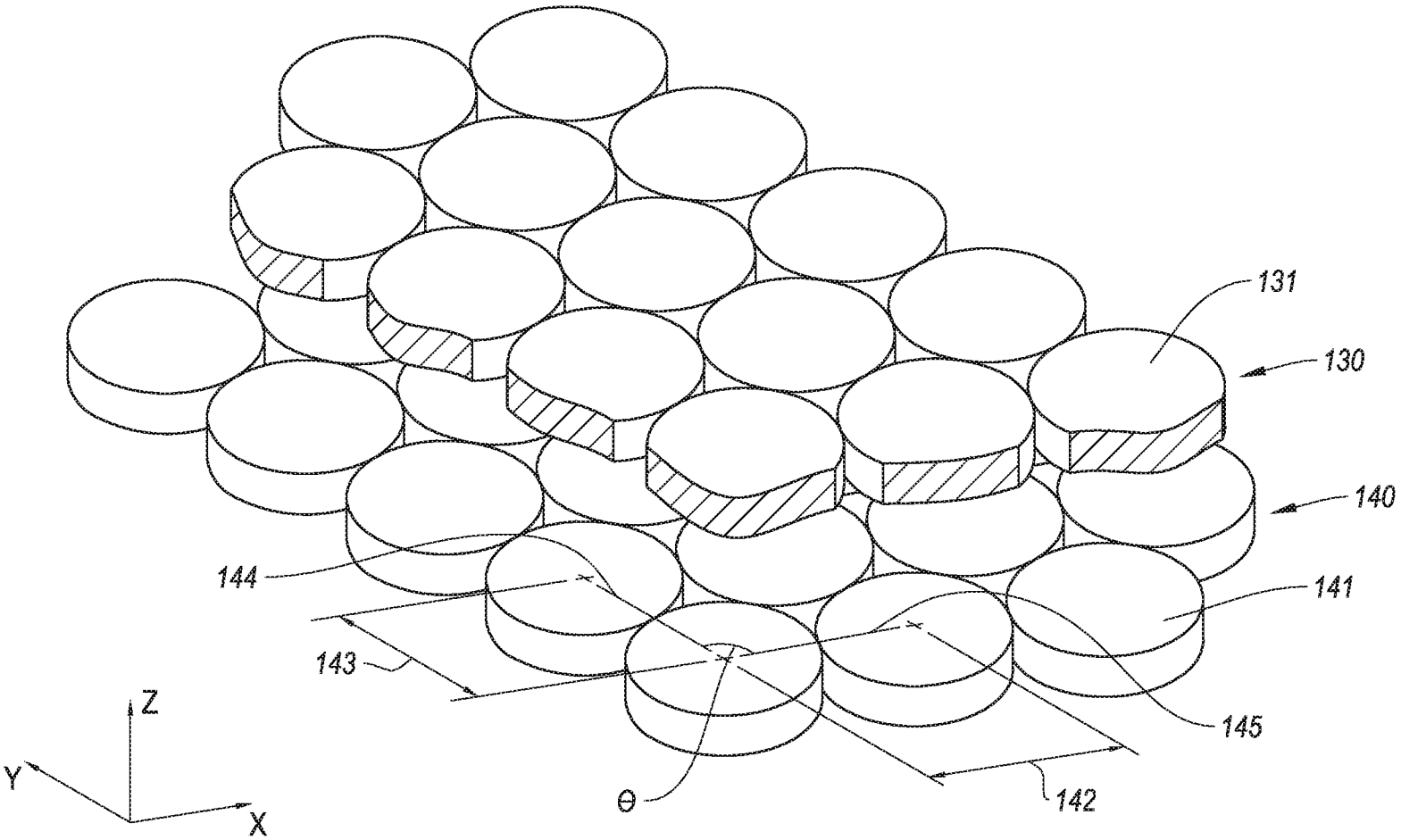
FIG. 2B is an isometric cutaway view of the selectively stiffenable layer of FIG. 2A.

Generally, the shield segments can have any number of suitable shapes, sizes, and arrangements that can vary from one embodiment to the next. FIGS. 2A-2B illustrate a first stiffenable layer 130 and a second stiffenable layer 140, according to an embodiment. Specifically, FIG. 2A is a top plan view of the first stiffenable layer 130 and second stiffenable layer 140, with the first stiffenable layer 130 positioned above the second stiffenable layer 140. FIG. 2B is an isometric cutaway view of the first stiffenable layer 130 and second stiffenable layer 140. In an embodiment, each of the first stiffenable layer 130 and second stiffenable layer 140 can include multiple respective shield segments, such as shield segments 131 in the first stiffenable layer 130 and shield segments 141 in the second stiffenable layer 140.

In the illustrated embodiment, the shield segments 131 and shield segments 141 are defined by a generally circular perimeter (e.g., the shield segments 131 or shield segments 141 can be cylindrical, domed or generally lens-shaped, etc.). Moreover, the shield segments 131 and shield segments 141 can have a lateral dimension (e.g., diameter or other lateral dimension) that is substantially greater than the thicknesses thereof. For example, the lateral dimension of the shield segments 131 or shield segments 141 can be 1.1×, 1.5×, 2×, 3×, 4×, 5×, 10×, 100×, or more than 100 times greater than the thickness of the shield segments 131 or shield segments 141. Generally, the shield segments 131 or shield segments 141 can have any suitable thickness. In an embodiment, the thickness of the shield segments 131 or shield segments 141 can be in one or more of the following ranges: from about 0.005 inches to about 0.020 inches; from about 0.015 inches to about 0.050 inches; from about 0.035 inches to about 0.100 inches; from about 0.85 inches to about 0.200 inches; from about 0.150 inches to about 0.300 inches. It should be appreciated, however, that the thickness of the shield segments 131 or shield segments 141 can be greater than 0.300 inches or less than 0.005 inches. In an embodiment, the shield segments 131 and/or shield segments 141 can be fabricated from a sheet material, such as plastic sheet (e.g., thermoplastic, thermoset), composite material (e.g., carbon fiber, fiberglass, etc.), paper (e.g., laminated paper, paperboard, water-resistant paper, such as wax paper, etc.), metal, combinations thereof, etc.

It should be appreciated that the shield segments 131 or the shield segments 141 can have any number of suitable shapes and/or configurations. For example, the shield segments 131 and/or shield segments 141 can have a generally polygonal perimeter, irregular-shaped perimeter, etc. Furthermore, some or each of the shield segments 131 of the first stiffenable layer 130 or shield segments 141 of the second stiffenable layer 140 can have the same shape or size or can have different shapes or sizes. Also, the shield segments 131 or shield segments 141 can have any number of suitable thicknesses that can vary from one embodiment to the next. For example, the thicknesses of the shield segments 131 or shield segments 141 can be similar to or substantially the same as corresponding lateral dimensions of the shield segments 131 and shield segments 141.

In an embodiment, the shield segments 131 can have a first arrangement (e.g., relative to each other or relative to a reference point), and the shield segments 141 can have a second arrangement. For example, the first and second arrangements can be different from each other in one or more aspects. In an embodiment, the first and second arrangements can position the shield segments 131 and shield segments 141 relative to one another such that shield segments 131 and shield segments 141 only partially overlap. For example, the first and second arrangement can facilitate bending or deformation of the first stiffenable layer 130 or second stiffenable layer 140 (e.g., to facilitate corresponding movement or bending of one or more body portions of the individual).

Generally, the first and second shield stiffenable layers 130, 140 can have respective shield segments 131 or 141 can be closely packed (e.g., adjacent ones of the shield segments can be positioned near or in contact with one another). Alternatively, the first and second shield stiffenable layers 130, 140 can have respective shield segments 131 or 141 can be spaced apart. For example, adjacent ones of the shield segments can be spaced apart by a spacing distance (e.g., the spacing distances between shield segments can be less than a lateral dimension of the shield segments). In an embodiment, the spacing distance can be ½ of the lateral dimension of one or more of the adjacent shield segments.

In the illustrated embodiment, in the second arrangement, the shield segments 141 can abut or can be positioned near one another, such that the perimeters of the adjacent shield segments 141 are in contact with one another or positioned near one another (as shown in FIG. 2B). For example, the shield segments 141 can have a radius R1 and can be spaced one from another along x-axis at an x-spacing 142 that is similar to or the same as R1. Furthermore, the shield segments 141 can have y-spacing 143 along y-axis, which can be greater than R1. For example, the y-spacing can be approximately R1×(1+arcsin 60°). In the illustrated embodiment, the shield segments 141 can be arranged along adjacent rows, such that the shield segments 141 in one row are positioned partially between the shield segments 141 in the adjacent row.

For example, the shield segments 141 can be arranged such that a reference line 144 extending between centers of the shield segments 141 in a first row and the shield segments 141 in an adjacent, second row form an offset angle θ relative to a reference line 145 that can be generally perpendicular to a line along which the shield segments 141 of the first row are aligned. In the illustrated embodiment, the offset angle θ is about 60°. It should be appreciated that the offset angle θ can be any suitable angle, such that the adjacent rows of the shield segments 141 have any suitable offset therebetween. Moreover, the second arrangement can be an ordered arrangement (e.g., an array) or a disordered arrangement. In any event, in an embodiment, the shield segments 141 can be arranged in the second arrangement and can move or deform in a manner that allows the second stiffenable layer 140 to deform or conform to the body of the individual (e.g., as described above).

In an embodiment, in the first arrangement, the shield segments 131 can have the same or similar spacing or relative positions as the shield segments 141 in the second arrangement. As mentioned above, the first and second arrangement can be different from each other relative to a reference point (e.g., relative to a center of one of the shield segments 131). For example, the first arrangement can be shifted or offset relative to the second arrangement, such the centers of the shield segments 131 and shield segments 141 are misaligned or offset relative to one another (e.g., such that the shield segments 131 overlap multiple shield segments 141 or vice versa).

As noted above, in an embodiment, the shield segments 131 and shield segments 141 can have the same size or shape. For example, the shapes of the shield segments 131 can be defined by respective circular perimeters that has a radius R2. In an embodiment, the radius R2 can be similar to or the same as the radius R1. Alternatively, the radius R2 can be greater than or smaller than the radius R1.

In an embodiment, the first arrangement can have the shield segments 131 positioned relative to one another such that extending reference lines between centers of adjacent ones of the shield segments 131 can form or define reference triangles, hexagons, rectangles (e.g., squares), other polygon, etc. Similarly, the second arrangement can have the shield segments 141 can be positioned relative to one another such that extending reference lines between centers of adjacent ones of the shield segments 141 can form or define reference triangles, hexagons, rectangles (e.g., squares), etc. One or more of the dimensions of such reference geometries (e.g., triangles, hexagons, rectangles) can selectively change in one or more dimensions over or along the first or second arrangements, while in other embodiments, the dimensions of the reference geometries can remain substantially constant.

In an embodiment, as shown in FIG. 2A, the first arrangement can be offset relative to the second arrangement along x-axis by an arrangement x-offset 146. For example the arrangement x-offset 146 can be approximately equal to the radius R1. Moreover, the first arrangement of the shield segments 131 can be offset relative to the second arrangement of shield segments 141 along y-axis by an arrangement y-offset 147. For example, the arrangement y-offset 147 can be approximately equal to the radius R1×arcsin 60°. It should be appreciated that the first and second arrangements can have any number of suitable offsets therebetween (e.g., along x-axis or along y-axis), which can vary from one embodiment to the next.

In an embodiment, the shield segments 131 of the first stiffenable layer 130 can be operably connected or secured together. For example, the shield segments 131 can be connected together by one or more connectors (e.g., links, cables). Additionally or alternatively, the shield segments 131 can be operably connected or secured to a layer or sheet that can connect together the shield segments 131. For example, the shield segments 131 can be secured to a sheet of cloth (e.g., to a substantially continuous cloth material) or thin and flexible material, such that the shield segments 131 can move relative to one another and allow the first stiffenable layer 130 to conform to one or more contours of an individual. Moreover, the shield segments 141 of the second stiffenable layer 140 can be operably connected or secured together in a similar manner as the shield segments 131.

Figure 3A:
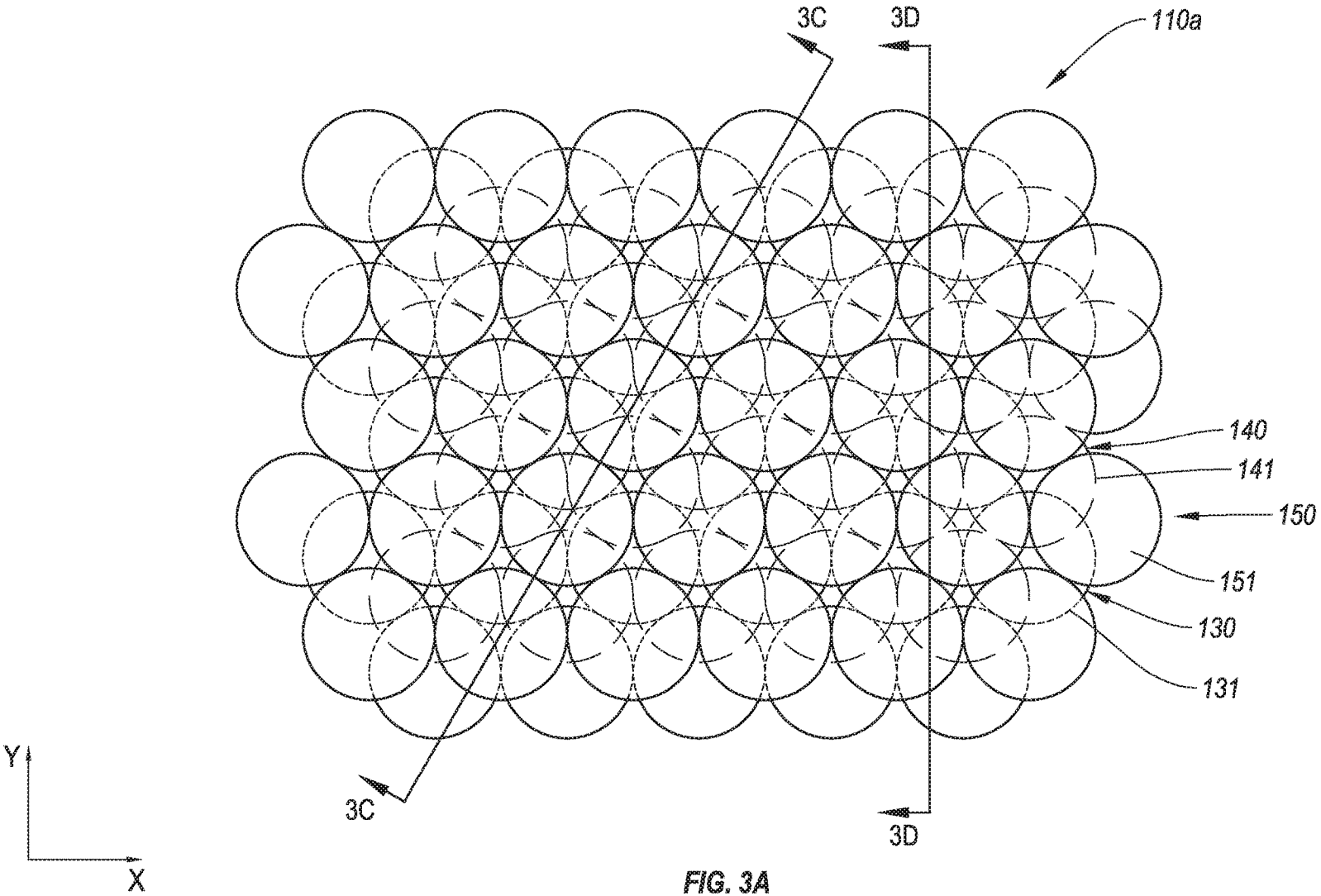
FIG. 3A is a top plan view of a selectively stiffenable assembly according to an embodiment.
Figure 3B:
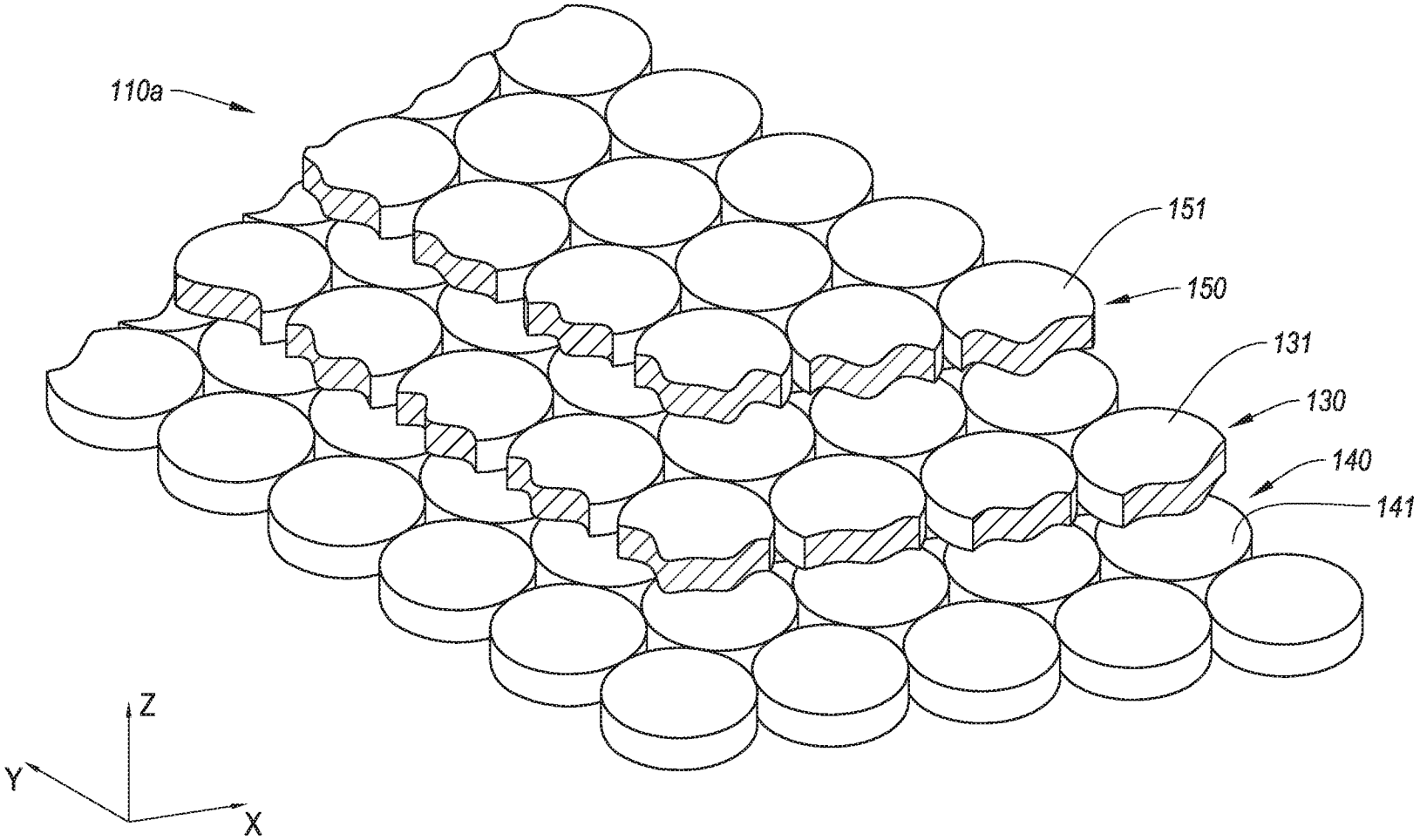
FIG. 3B is an isometric cutaway view of the selectively stiffenable assembly of FIG. 3A.
Figure 3C:
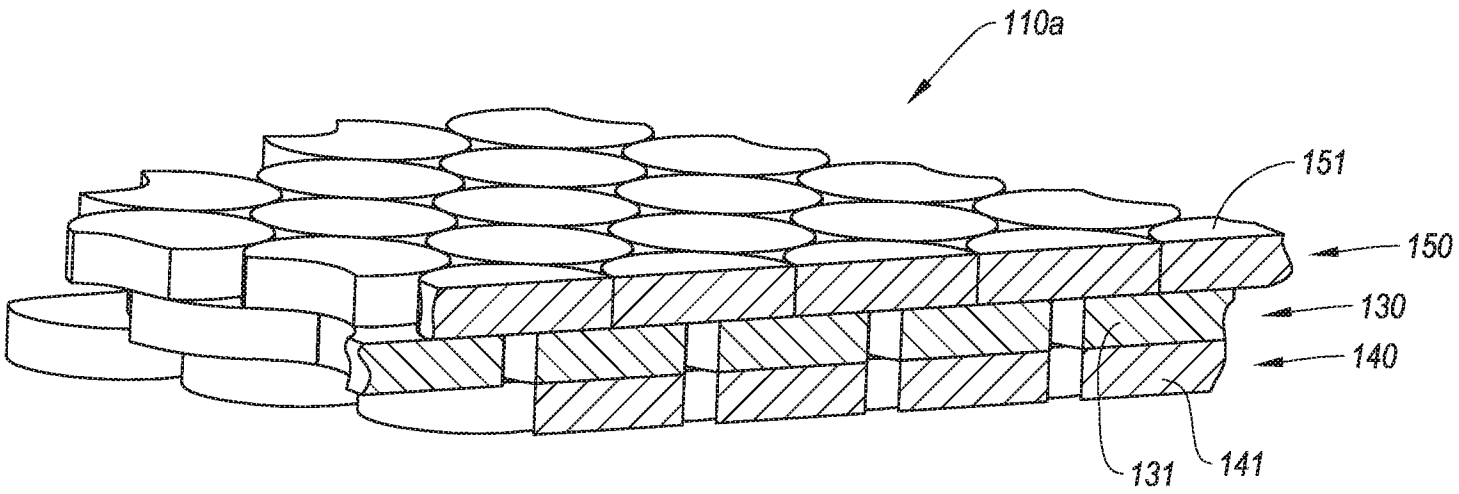
FIG. 3C is an isometric cutaway view of the selectively stiffenable assembly of FIG. 3A.
Figure 3D:
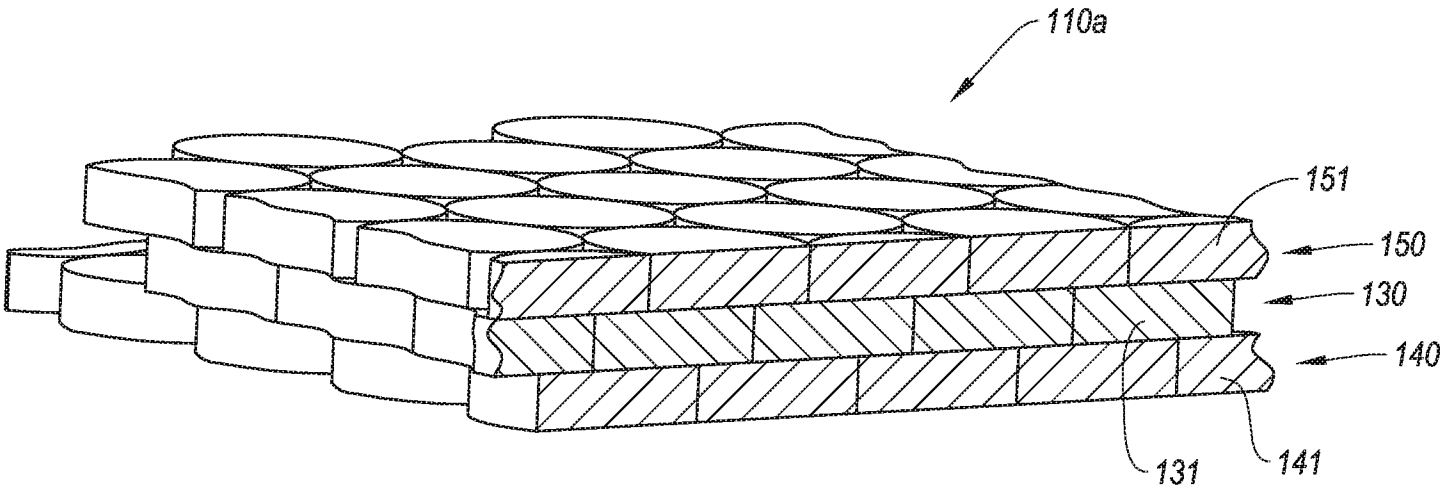
FIG. 3D is another isometric cutaway view of the selectively stiffenable assembly of FIG. 3A.

As described above, the selectively stiffenable assembly can include a compression mechanism that can selectively compress and stiffen the stiffenable layers of the selectively stiffenable assembly. In an embodiment, the compression mechanism can include at least one layer that can selectively press together the stiffenable layers of the selectively stiffenable assembly, thereby reducing flexibility of or stiffening the selectively stiffenable assembly. FIGS. 3A-3D illustrate a selectively stiffenable assembly 110*a* according to an embodiment. In particular, FIG. 3A is a top plan view of the selectively stiffenable assembly 110*a*; FIG. 3B is an isometric view of the selectively stiffenable assembly 110*a*, FIG. 3C is an isometric cutaway view of the selectively stiffenable assembly 110*a* (the cross-section plane is indicated with a cross-section line 3C-3C, shown in FIG. 3A), and FIG. 3D is another isometric cutaway view of the selectively stiffenable assembly 110*b* (the cross-section is indicated with a cross-section line 3D-3D, shown in FIG. 3A). Except as otherwise described herein, the selectively stiffenable assembly 110*a* can be similar to or the same as the selectively stiffenable assembly 110 (FIG. 1). In the illustrated embodiment, the selectively stiffenable assembly 110*a* includes a first compression layer 150 that is positioned adjacent to or above the first stiffenable layer 130 and second stiffenable layer 140.

As described below in more detail, the first compression layer 150 can press against the first stiffenable layer 130 and second stiffenable layer 140, thereby pressing together the shield segments 131 and shield segments 141 thereof, such as to reduce flexibility or increase stiffness of the selectively stiffenable assembly 110*a* (e.g., to increase sliding resistance between the shield segments 131 and shield segments 141). In an embodiment, the first compression layer 150 can include multiple compression elements 151 that can have a third arrangement. For example, the compression elements 151 can have the same arrangement relative to one another as the shield segments 131 of the first stiffenable layer or compression elements 151 of the second stiffenable layer 140 (described above).

In the illustrated embodiment, the third arrangement of the compression elements 151 can be different from the first arrangement of the shield segments 131 and second arrangements of the shield segments 141 (e.g., relative to a reference point). For example, the compression elements 151 in the third arrangement can be positioned relative to one another in similar to or the same as the shield segments 131 are positioned relative to one another in the first arrangement or similar to or the same as the shield segments 141 are positioned relative to one another in the second arrangement. In an embodiment, the first, second, and third arrangements can be offset relative to one another. For example, the third arrangement can have an x-offset or y-offset relative to the first and second arrangements (of the respective shield segments 131 and shield segments 141) that are different from the x- or y-offset between the first and second arrangements.

In an embodiment, the compression elements 151 can be positioned such that at least one of the compression elements 151 overlaps two or more shield segments 131 and two or more shield segments 141 (e.g., as shown in FIGS. 3C-3D). Hence, for example, when the compression elements 151 press against the shield segments 131 and the shield segments 141, one, some, or each of the compression elements 151 can apply pressure onto two or more of the shield segments 131 in the first stiffenable layer 130 and two or more of the shield segments 141 in the second stiffenable layer 140, thereby pressing together two or more of the shield segments 131 and two or more of the shield segments 141. It should be appreciated, however, that the first compression layer 150 can be configured such as to press together at least one of the shield segments 131 and at least one of the shield segments 141.

In any event, in an embodiment, the first compression layer 150 can press against the first stiffenable layer 130 in a manner that presses together the first stiffenable layer 130 and second stiffenable layer 140, thereby stiffening the selectively stiffenable assembly 110*a*. For example, the first compression layer 150 can press the first stiffenable layer 130 and second stiffenable layer 140 against one or more body portions of the individual, thereby compressing together the first stiffenable layer 130 and second stiffenable layer 140. As described below, in an embodiment, the selectively stiffenable assembly 110*a* can include at least one activation mechanism operably coupled or connected to the first compression layer 150. For example, the activation mechanism can force or urge the first compression layer 150 toward the individual wearing a protective garment that includes the selectively stiffenable assembly 110*a*, thereby reconfiguring the selectively stiffenable assembly 110*a* from undeployed configuration into deployed configuration.

In an embodiment, one or more of the first compression layer 150, first stiffenable layer 130, or second stiffenable layer 140 can include one or more elements or components configured to generate one or more energy fields that can attract the first stiffenable layer 130 to the first compression layer 150, thereby compressing together the first stiffenable layer 130 and second stiffenable layer 140, as the first compression layer 150 presses the first stiffenable layer 130 against the second stiffenable layer 140. For example, the first stiffenable layer 130 and first compression layer 150 can include energy-field-generation elements that can generate one or more electric or magnetic fields positioned and oriented to attract together the first stiffenable layer 130 and first compression layer 150. In an embodiment, the energy fields can be activated or oriented (or reoriented) responsive to one or more control signals received directly or indirectly from a controller (e.g., as described above, the controller can generate a control signal responsive to one or more signals received from one or more sensors, and the control signal can operate or direct operation of the energy field elements in a manner that reconfigures the selectively stiffenable assembly 110*a* from undeployed to deployed configuration).

In an embodiment, one or more of the first compression layer 150, first stiffenable layer 130, or second stiffenable layer 140 can include one or more magnetic elements that can interact with one another (e.g., a controller can generate or send a control signal that can direct operation of the magnetic elements, such as to align magnetic fields generated thereby North-to-South, in a manner that attracts together opposing magnetic elements). For example, magnetic elements in the second stiffenable layer 140 can be directed by the controller to generate a magnetic field having a first orientation, and the magnetic elements in the first compression layer 150 can be directed to generate a magnetic field having a second orientation that is generally opposite to the first orientation, such that the second stiffenable layer 140 is attracted to the first compression layer 150, thereby compressing together second stiffenable layer 130 and the first stiffenable layer 130. In another example, magnetic elements in the second stiffenable layer 140 can exhibit a magnetic field having a first orientation (e.g., permanent magnets), and the magnetic elements in the first compression layer 150 can be directed to generate a magnetic field having a second orientation that is generally opposite to the first orientation, such that the second stiffenable layer 140 is attracted to the first compression layer 150, thereby compressing together second stiffenable layer 130 and the first stiffenable layer 130. In yet another example, magnetic elements in the second stiffenable layer 140 can be directed by the controller to generate a magnetic field having a first orientation, and the magnetic elements in the first compression layer 150 can exhibit a magnetic field having a second orientation that is generally opposite to the first orientation (e.g., permanent magnets), such that the second stiffenable layer 140 is attracted to the first compression layer 150, thereby compressing together second stiffenable layer 130 and the first stiffenable layer 130.

In an embodiment, the energy-field-generation elements (e.g., magnetic elements) can be connected to or integrated with one or more of the shield segments 131, shield segments 141, or compression elements 151. For example, one or more conductive elements (e.g., conductive coils) can be mounted to or embedded in one, some, or each of the shield segments 131. Similarly, one or more conductive elements can be mounted to or embedded in one, some, or each of the shield segments 141. Additionally or alternatively, one or more conductive elements can be mounted to or embedded in one, some, or each of the compression elements 151. Hence, for example, the controller can directly or indirectly operate the conductive elements in one or more of the shield segments 131, shield segments 141, or compression elements 151 in a manner that attracts the shield segments 131 to the compression elements 151 or attracts the shield segments 131 to the shield segments 141, thereby increasing sliding resistance between the shield segments 131 and shield segments 141. Moreover, in an embodiment, the controller can directly or indirectly operate one or more of the conductive elements in the shield segments 131, shield segments 141, or compression elements 151 in a manner that one or more of repels the shield segments 131 from the compression elements 151 or repels the shield segments 131 from the shield segments 141, thereby reducing sliding resistance between the shield segments 131 and shield segments 141. It should be also appreciated that the first stiffenable layer 130, the second stiffenable layer 140, the first compression layer 150, or combinations thereof can include one or more permanent magnets that can interact with or can be attracted to one or more energy-field-generation elements (e.g., to electromagnetic elements) that can be controlled by the controller.

As described above, the first stiffenable layer 130, second stiffenable layer 140, and first compression layer 150 can be generally conformable to one or more contours of the individual (e.g., when the selectively stiffenable assembly 110*a* is in an undeployed configuration). For example, the selectively stiffenable assembly 110*a* can deform in a manner that facilitates movement of the individual (e.g., without restricting or substantially without restricting movement of the individual, such that the individual is able to move body portions thereof to desired or suitable positions and orientations). In an embodiment, the selectively stiffenable assembly 110*a* can be reconfigured from undeployed configuration to deployed configuration, when the first stiffenable layer 130 and second stiffenable layer 140 are compressed together to stiffen the selectively stiffenable assembly 110*a*. For example, the selectively stiffenable assembly 110*a* can be reconfigured from the undeployed to the deployed configuration, while one or more portions of the first stiffenable layer 130, second stiffenable layer 140, first compression layer 150, or combinations thereof are deformed to at least partially conform to one or more contours of the individual (e.g., to protect the individual).

It should be appreciated that the compression layer can have any number of suitable configurations. For example, a compression layer can be configured as a continuous sheet. Moreover, in an embodiment, the selectively stiffenable assembly can have multiple compression layers (e.g., comprising multiple compression elements or at least one compression layer that comprises a single compression element, such as a continuous sheet). For example, compression layers can be positioned on opposing sides of the stiffenable layers and can compress together, thereby compressing therebetween the stiffenable layers and reducing flexibility thereof (e.g., to reconfigure the selectively stiffenable assembly from undeployed to deployed configuration and protect one or more body portions of the individual from impact).

Moreover, the first and second stiffenable layers 130, 140 can be deformable or at least partially flexible while under some or partial compression. For example, when the selectively stiffenable assembly 110 is in undeployed configuration, the first and second stiffenable layers 130, 140 can be compressed together to have a first compression or to produce a first sliding resistance. When the selectively stiffenable assembly 110 is in deployed configuration, the first and second stiffenable layers 130, 140 can be compressed together to have a second compression or to produce a second sliding resistance, which can be greater than the first compression or first sliding resistance, respectively.

In an embodiment, the shield segments 131 or 141 of the respective first and second stiffenable layers 130, 140 can have retractable protrusions that can extend therebetween to produce interlocking or increase sliding resistance between the shield segments 131 and 141. For example, the protrusions can be activated by internal pressure or solenoids to move outward or into the space between the shield segments 131 and 141 to increase sliding resistance between the first and second stiffenable layers 130, 140 and to reconfigure the selectively stiffenable assembly 110 from undeployed to deployed configuration.

Figure 4A:
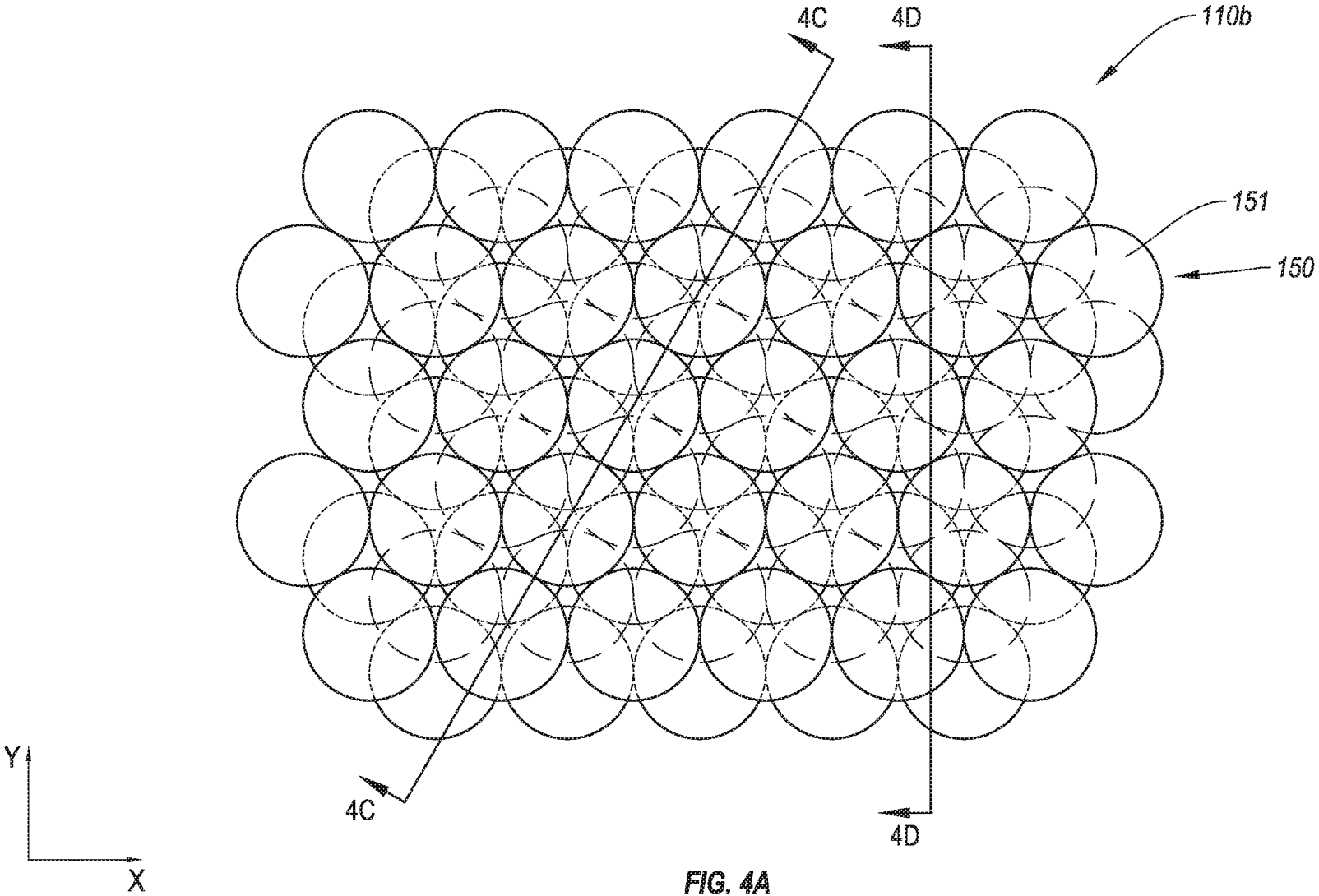
FIG. 4A is a top plan view of a selectively stiffenable assembly according to an embodiment.
Figure 4B:
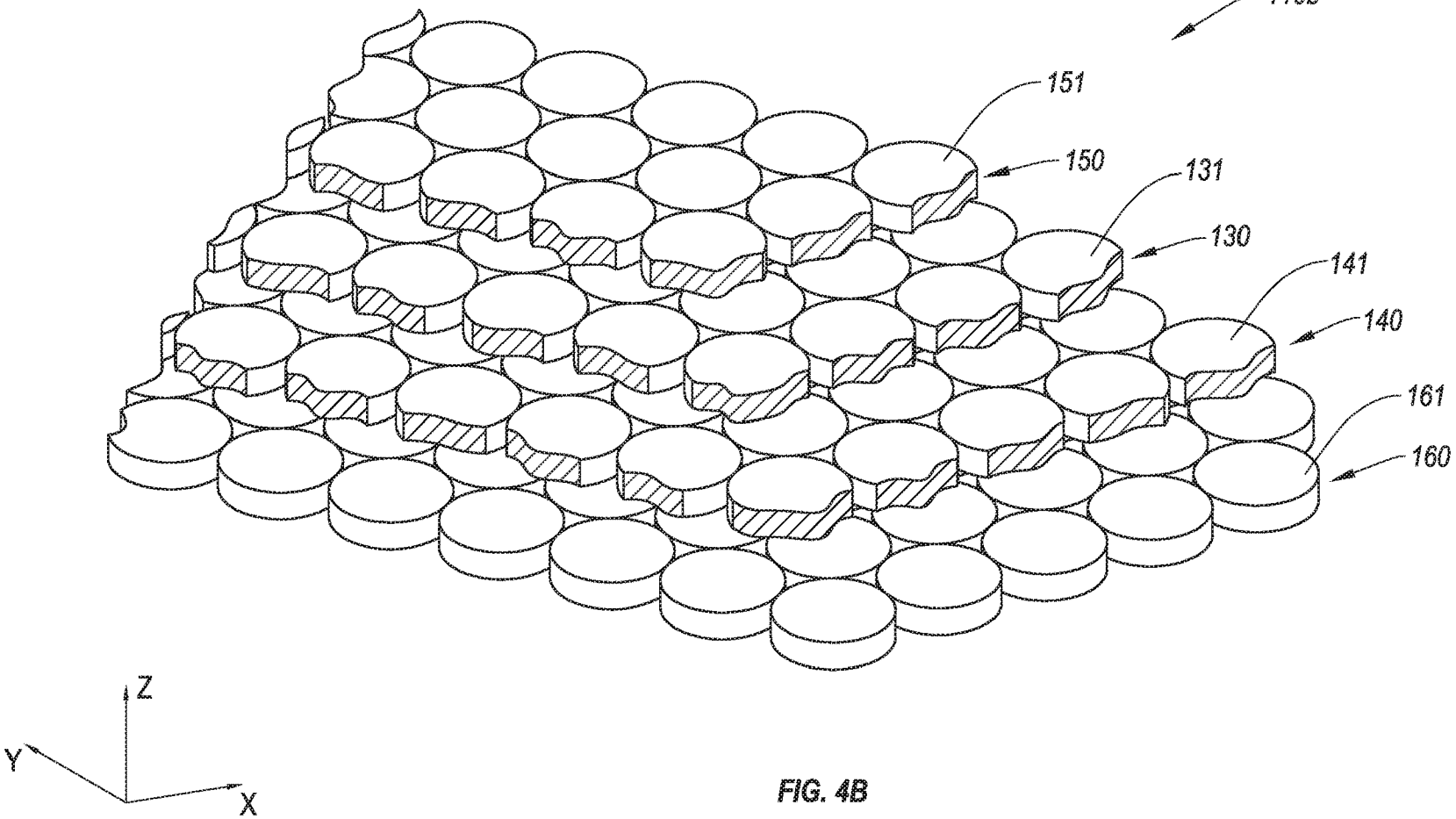
FIG. 4B is an isometric cutaway view of the selectively stiffenable assembly of FIG. 4A.
Figure 4C:
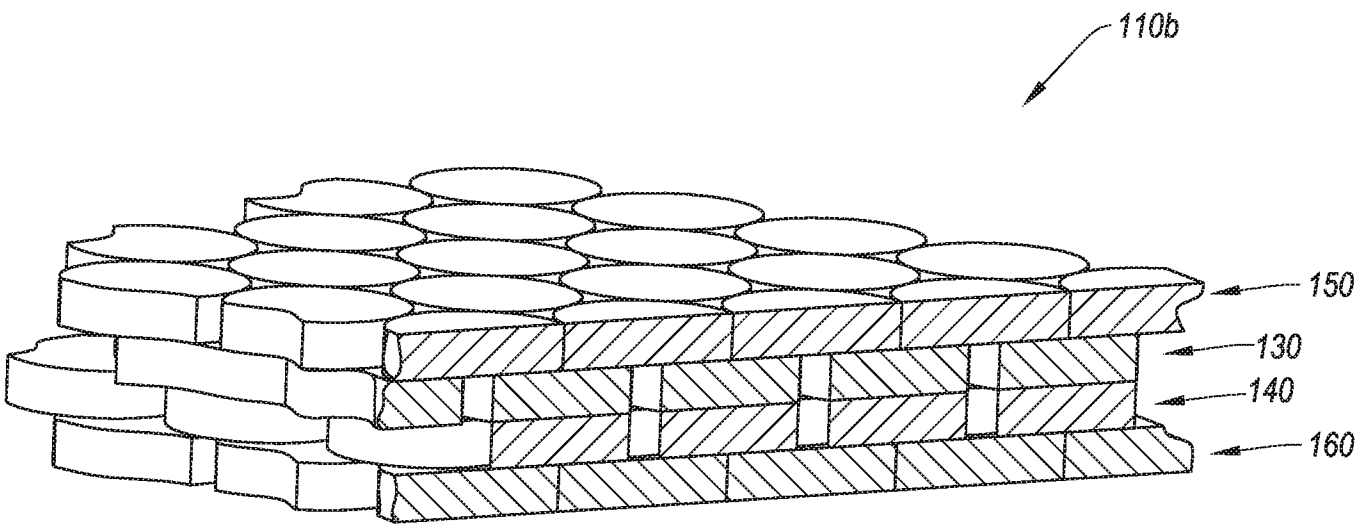
FIG. 4C is an isometric cutaway view of the selectively stiffenable assembly of FIG. 4A.
Figure 4D:
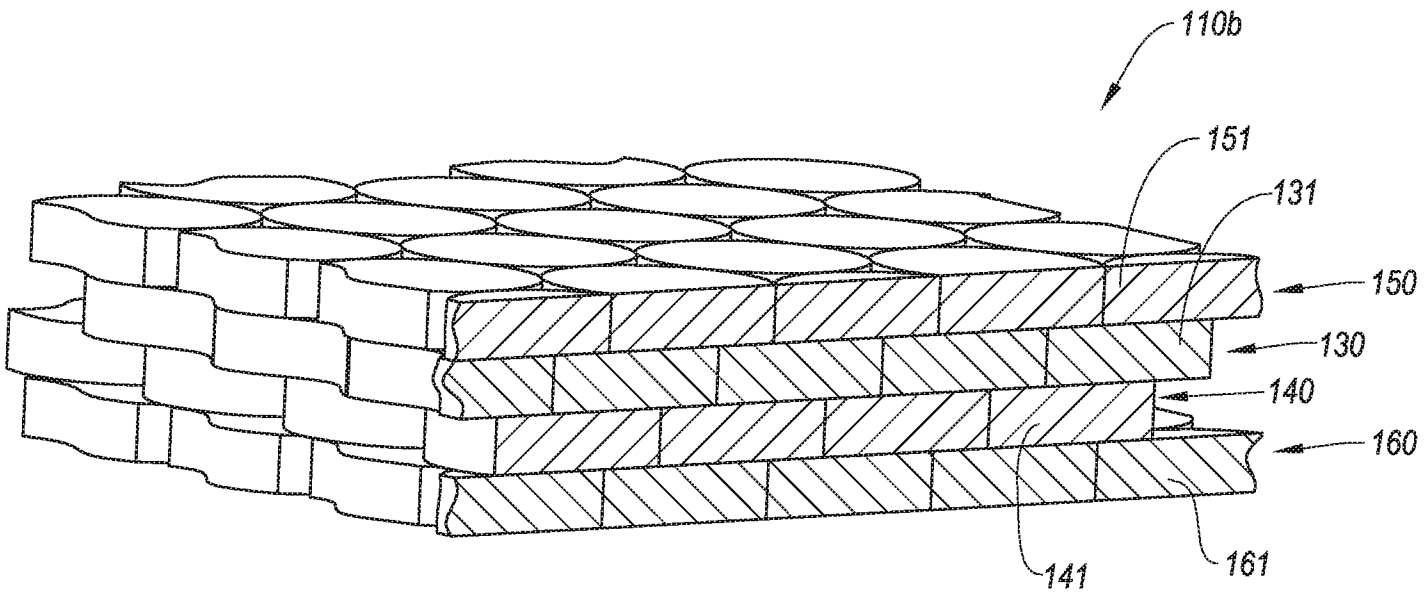
FIG. 4D is another isometric cutaway view of the selectively stiffenable assembly of FIG. 4A.

FIGS. 4A-4D illustrate a selectively stiffenable assembly 110*b* according to an embodiment. In particular, FIG. 4A is a top plan view of the selectively stiffenable assembly 110*b*; FIG. 4B is an isometric view of the selectively stiffenable assembly 110*b*, FIG. 4C is an isometric cutaway view of the selectively stiffenable assembly 110*b* (the cross-section plane is indicated with a cross-section line 4C-4C, shown in FIG. 4A), and FIG. 4D is another isometric cutaway view of the selectively stiffenable assembly 110*b* (the cross-section is indicated with a cross-section line 4D-4D, shown in FIG. 4A).

As shown in FIGS. 4A-4D, the selectively stiffenable assembly 110*b* can include the first stiffenable layer 130, second stiffenable layer 140, and first compression layer 150 that can be similar to or the same as the first stiffenable layer 130, second stiffenable layer 140, first compression layer 150 of the selectively stiffenable assembly 110*a* (FIGS. 3A-3D). Moreover, the selectively stiffenable assembly 110*b* can include a second compression layer 160. In the illustrated embodiment, the second compression layer 160 can be positioned generally opposite to the first compression layer 150, such as to sandwich the first stiffenable layer 130 and second stiffenable layer 140 between the first compression layer 150 and the second compression layer 160. In particular, for example, a compression mechanism can include the first compression layer 150, second compression layer 160, and one or more actuators operably coupled to or integrated with the first compression layer 150 and second compression layer 160. The actuators can force or urge the first compression layer 150 and second compression layer 160 toward each other, thereby compressing the first stiffenable layer 130 and second stiffenable layer 140 therebetween.

As described above, the actuators can include one or more elements or components configured to generate one or more energy fields. For example, actuators can include one or more energy-field-generation elements (e.g., magnetic elements, such as ferromagnetic elements, electromagnetic elements, conductive elements, such as coils configured to generate electric field, etc.). The energy-field-generation elements can be attached to or incorporated into the first compression layer 150 or second compression layer 160.

As described above, the first compression layer 150 can include compression elements 151. In an embodiment, the second compression layer 160 can have a similar configuration to the first compression layer 150. For example, the second compression layer 160 can include multiple compression elements 161. In the illustrated embodiment, the compression elements 161 can be arranged in a fourth arrangement. For example, the fourth arrangement of the compression elements 161 can be similar to or the same as the third arrangement of the shield elements 151 (e.g., one, some, or each of the compression elements 161 can be aligned with corresponding ones of the compression elements 151 of the first compression layer 150 (as shown in FIGS. 4C-4D)). In an embodiment, energy-field-generation element(s) can be mounted to or embedded in one, some, or each of the compression elements 161.

In an embodiment, a controller (e.g., controller 200 (FIGS. 1A-1B)) can operate or direct operation of the energy-field-generation elements (e.g., responsive to one or more signals received from one or more sensors) in a manner that attracts together the first compression layer 150 and second compression layer 160 to compress the first stiffenable layer 130 and second stiffenable layer 140, thereby stiffening the selectively stiffenable assembly 110*b* and reconfiguring the selectively stiffenable assembly 110*b* from undeployed into deployed configuration. For example, the energy fields can be relatively aligned in a manner that attracts the first compression layer 150 to the second compression layer 160. Additionally or alternatively, the controller can operate or direct operation of the energy-field-generation elements to repel the first compression layer 150 and second compression layer 160 from each other, thereby reconfiguring the selectively stiffenable assembly 110*b* from the deployed configuration to the undeployed configuration and increasing the flexibility of the selectively stiffenable assembly 110*b*.

In an embodiment, the third arrangement of the compression elements 151 and the fourth arrangement of the compression elements 161 can position the compression elements 151 and compression elements 161 relative to the shield segments 131 and shield segments 141, such that when the compression elements 151 are forced or urged toward the compression elements 161, each of the compression elements 151 presses against multiple shield segments 141 and each of the compression elements 151 presses against multiple shield segments 131. It should be appreciated, however, that the compression elements 151 and compression elements 161 can have any number of suitable arrangements relative to one another and relative to the shield segments 141 or shield segments 131. For example, at least one of the compression elements 151 can press against at least one of the shield segments 141 and at least one of the compression elements 161 can press against at least one of the shield segments 131.

In the illustrated embodiment, the selectively stiffenable assembly 110*b* includes two stiffenable layers, the first stiffenable layer 130 and second stiffenable layer 140. In alternative or additional embodiment, a selectively stiffenable assembly can include any number of stiffenable layers, which can be selectively stiffened by one or more compression mechanisms (e.g., such as a compression mechanism that include the first compression layer 150 and second compression layer 160). For example, the selectively stiffenable assembly 110*b* can include any number of alternating stiffenable layers, such that two or more of the stiffenable layers are configured or arranged similar to or the same as the first stiffenable layer 130 and at least one layer adjacent thereto and positioned therebetween that is configured or arranged similar to or the same as the second stiffenable layer 140; the stiffenable layers can be positioned between the first compression layer 150 and second compression layer 160.

Moreover, one, some, or each of the stiffenable layers can include one or more corresponding actuators (e.g., energy-field-generation elements). For example, one or more of the stiffenable layers can include magnetic elements, and one or more of the stiffenable layers can be passive or without an actuator (e.g., one or more passive stiffenable layers can be compressed together or to other layers by the compression layers or by active stiffenable layers that include or operably coupled to one or more actuators).

In an embodiment, the alternating stiffenable layers can have two different arrangements that can be different between adjacent stiffenable layers. Generally, however, the selectively stiffenable assembly can include stiffenable layers with any number of suitable arrangements. For example, adjacent stiffenable layers can include shield segments that partially overlap or completely overlap one another. Moreover, the adjacent stiffenable layers can include shield segments that can be arranged such that a shield segment in one stiffenable layer overlaps two or more shield segments in each of the adjacent stiffenable layers. Additionally or alternatively, in an embodiment, at least one of the stiffenable layer may be decoupled or may not be operably coupled to a compression mechanism. For example, at least one stiffenable layer can be surrounded by two outer stiffenable layers that can be operably coupled to the compression mechanism (e.g., the outer stiffenable layers may be adjacent to opposing compression layers that can compress together the stiffenable layers therebetween).

As mentioned above, selectively stiffenable assembly can include any number of suitable compression mechanisms, and the compression mechanism(s) can include any number of suitable actuators. For example, as described above, compression mechanism can include one or more compression layers and the actuators can include one or more energy-field-generation elements. Moreover, in an embodiment, compression mechanism can be included or integrated in the stiffenable layers (e.g., the actuators, such as energy-field-generation elements, can be mounted to or integrated with one or more portions of the stiffenable layers) and can increase sliding resistance between two adjacent stiffenable layers.

In an embodiment, the selectively stiffenable assembly 110*b* can include one or more energy-absorbing materials (e.g., foams, gels, etc.). For example, the energy-absorbing materials can be disposed adjacent to the shield segments 131 of the first stiffenable layer 130 or adjacent to the shield segments 141 of the second stiffenable layer 140. Additionally or alternatively, the energy-absorbing materials can be disposed adjacent to the first compression layer 150 or adjacent to the second compression layer 160. For example, the energy-absorbing materials can be disposed adjacent to an outward facing surface of the first compression layer 150 (e.g., near the surface facing away from the individual wearing the protective garment that includes the selectively stiffenable assembly 110). In an embodiment, the energy-absorbing materials can be disposed adjacent to an inward facing surface of the second compression layer 160 (e.g., near the surface facing toward from the individual wearing the protective garment that includes the selectively stiffenable assembly 110).

Figure 5:
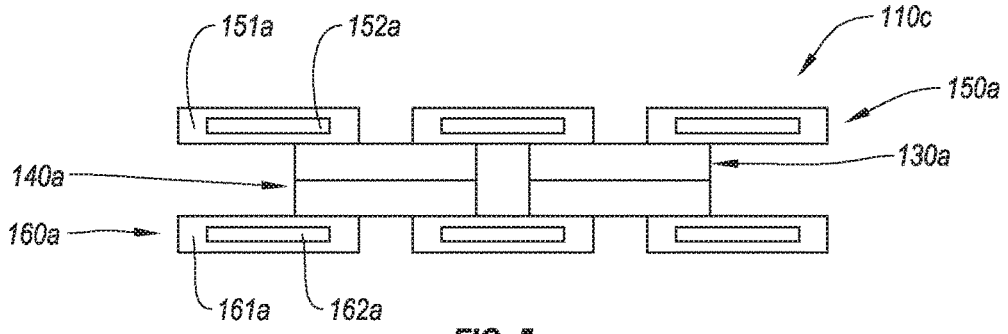
FIG. 5 is a schematic side view of a selectively stiffenable assembly, according to an embodiment.

FIG. 5 is a schematic side view of a selectively stiffenable assembly 110*c*, according to an embodiment. Except as described herein, the selectively stiffenable assembly 110*c* and its elements or components can be similar to or the same as any of the selectively stiffenable assembly 110, 110*a*, 110*b* (FIGS. 1-4) and their corresponding elements or components. For example, the selectively stiffenable assembly 110*c* can include first stiffenable layer 130*a*, second stiffenable layer 140*a*, first compression layer 150*a*, and second compression layer 160*a* that can be similar to or the same as the respective first stiffenable layer 130, second stiffenable layer 140, first compression layer 150, and second compression layer 160 of the selectively stiffenable assembly 110*b* (FIGS. 4A-4D).

Moreover, in an embodiment, the first compression layer 150*a* can include one or more compression elements 151*a*, and the second compression layer 160*a* can include one or more compression elements 161*a*. As described above, the first and second compression layers 150*a*, 160*a* can include one or more energy-field-generation elements (e.g., electromagnets, permanent magnets, conductive elements, such as conductive coils, combinations of the foregoing, etc.) that can be configured to attract together the first and second compression layers 150*a*, 160*a*, thereby reconfiguring the selectively stiffenable assembly 110*c* from undeployed to deployed configuration. In the illustrated embodiment, the first compression layer 150*a* can include energy-field-generation elements 152*a*, and the second compression layer 160*a* can include energy-field-generation elements 162*a*.

For example, the energy-field-generation elements 152*a* can be embedded in the compression elements 151*a*, and the energy-field-generation elements 162*a* can be embedded in the compression elements 161*a*. Additionally or alternatively, the energy-field-generation elements 152*a* or 162*a* can be mounted or attached to the respective compression elements 151*a*, 161*a*. In any event, in an embodiment, the energy-field-generation elements 152*a*, 162*a* can attract together the first and second compression layers 150*a*, 160*a* to reconfigure the selectively stiffenable assembly 110*c* from undeployed to deployed configuration.

Figure 6:
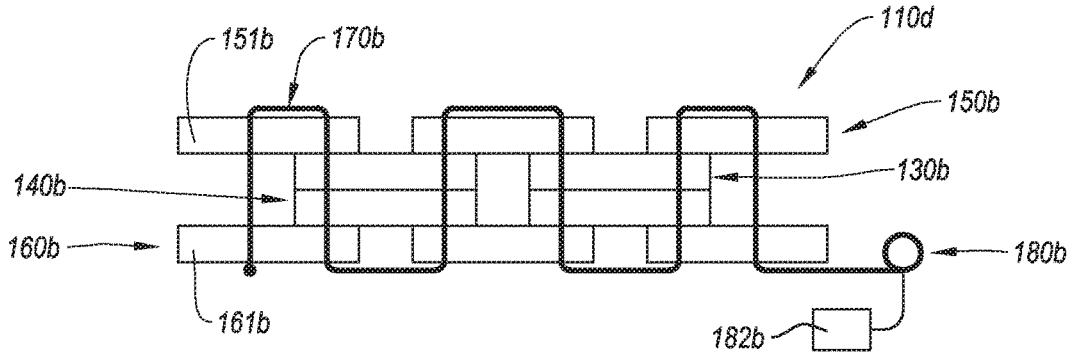
FIG. 6 is a schematic side view of a selectively stiffenable assembly, according to an embodiment.

In an embodiment, the actuators can include one or more elements that can be configured to apply external force(s) to the compression layers. FIG. 6 is a schematic side view of a selectively stiffenable assembly 110*d* according to an embodiment. Except as described herein, the selectively stiffenable assembly 110*d* and its elements or components can be similar to or the same as any of the selectively stiffenable assembly 110, 110*a*, 110*b*, 110*c* (FIGS. 1-5) and their corresponding elements or components. For example, the selectively stiffenable assembly 110*d* can include first stiffenable layer 130*b*, second stiffenable layer 140*b*, first compression layer 150*b*, and second compression layer 160*b* that can be similar to or the same as the respective first stiffenable layer 130, second stiffenable layer 140, first compression layer 150, and second compression layer 160 of the selectively stiffenable assembly 110*b* (FIGS. 4A-4D).

In an embodiment, the selectively stiffenable assembly 110*d* can include one or more cables 170*b* operably coupled to the first compression layer 150*b* and to the second compression layer 160*b*, such that shortening a free length of the cable 170*b* or increasing a tension of the cable 170*b* can force or urge the first compression layer 150*b* and the second compression layer 160*b* toward each other, thereby compressing together the first stiffenable layer 130*b* and second stiffenable layer 140*b* to increase the stiffness of the selectively stiffenable assembly 110*d* and reconfigure the selectively stiffenable assembly 110*d* from the undeployed configuration into the deployed configuration. Additionally or alternatively, increasing the free length of the cable 170*b* or decreasing the tension of the cable 170*b* can allow the first compression layer 150*b* and second compression layer 160*b* to move farther away from each other, to reconfigure the selectively stiffenable assembly 110*d* from the deployed configuration to undeployed configuration, in which the selectively stiffenable assembly 110*d* has increased flexibility (as compared to the deployed configuration). For example, the first compression layer 150*b* and second compression layer 160*b* can move away from each other responsive to the movement or bending of the first stiffenable layer 130*b* and second stiffenable layer 140*b*.

In an embodiment, the free length of the cable 170*b* can be defined by the length of the cable 170*b* positioned externally of a length-shortening device, such as a spindle 180*b* (e.g., the length of the cable 170*b* positioned between the first compression layer 150*b* and second compression layer 160*b*). For example, the cable 170*b* can be operably connected or coupled to spindle 180*b* that can reduce the free length of the cable 170*b* and force or urge the first compression layer 150*b* and second compression layer 160*b* toward each other and reconfigure the selectively stiffenable assembly 110*d* from undeployed to deployed configuration. In an embodiment, the spindle 180*b* can be operably coupled to a controller that can operate or direct operation of the spindle 180*b* (e.g., as described above). For example, the controller can operate or direct operation of the spindle 180*b* to reconfigure the selectively stiffenable assembly 110*d* between deployed and undeployed configurations responsive to one or more signals received at the controller from one or more sensors. In an embodiment, the selectively stiffenable assembly 110*d* can include or can be operably coupled to an actuator 182*b* that can operate the spindle 180*b*, as described below (e.g., the actuator 182*b* can be operably coupled to the controller to receive control signals therefrom and can operate the spindle 180*b* responsive to the control signals received from the controller).

In an embodiment, the spindle 180*b* can be a fluid-expandable bellows that can expand and contract responsive to fluid flowing thereto or therefrom, respectively, and the actuator 182*b* can be a pump, compressor, a reservoir of pressurized fluid with controllable fluid release (e.g., with a valve), etc. For example, the spindle 180*b* can be configured to reduce the free length of the cable 170*b* or increase the tension of the cable 170*b* responsive to expansion of the spindle 180*b*. Conversely, for example, the spindle 180*b* can increase the free length of the cable 170*b* or decrease the tension of the cable 170*b* responsive to contraction of the spindle 180*b*. In an embodiment, to reconfigure the selectively stiffenable assembly 110*d* between the deployed and undeployed configurations, the controller can operate or direct operation of the spindle 180*b* between expanded and contracted configurations, thereby reconfiguring the selectively stiffenable assembly 110*d* between deployed and undeployed configurations, respectively.

In an embodiment, the spindle 180*b* can be pivotable or rotatable about an axis and the actuator 182*b* can be a motor. For example, pivoting or rotating the spindle 180*b* about the axis in a first direction can reduce the free length of the cable 170*b* or increase the tension of the cable 170*b*. Conversely, in an embodiment, pivoting or rotating the spindle 180*b* about the axis in a second direction (opposite to the first direction) can increase the free length of the cable 170*b* or reduce tension of the cable 170*b*. Accordingly, for example, the controller can operate or direct operation of the spindle 180*b* in a manner that pivots or rotates the spindle 180*b* to reconfigure the selectively stiffenable assembly 110*d* between the deployed and undeployed configurations.

As described above, the first compression layer 150*b* can include one or more compression elements 151*b*, and the second compression layer 160*b* can include one or more compression elements 161*b*. For example, one, some, or each of the compression elements 151*b* and compression elements 161*b* can have one or more openings that can accept the cable 170*b* therethrough. In an embodiment, the cable 170*b* can be threaded through the first compression layer 150*b* and through the second compression layer 160*b*, such that reducing the free length of the cable 170*b* or increasing tension of the cable 170*b* can reconfigure the selectively stiffenable assembly 110*d* from the undeployed configuration into the deployed configuration.

Generally, the cable 170*b* can be threaded through the first compression layer 150*b* and second compression layer 160*b* to form any number of suitable patterns of threading. For example, as shown in FIG. 6, the cable 170*b* can be threaded such as to form an alternating or zigzag threading pattern or path. Alternatively or additionally, the cable 170*b* can be threaded to form a generally spiral threading pattern or path. It should be appreciated that the selectively stiffenable assembly 110*d* can include multiple cables or multiple spindles that can be connected to a single cable (e.g., at opposing ends thereof) or to multiple cables (e.g., one or more spindles per cable). Moreover, in an embodiment, the cable 170*b* can be threaded through any number of stiffenable layers and any number of shield segments thereof. For example, one, some, or each of the shield segments 131*a* or the shield segments 141*a* can have one or more openings, and the cable 170*b* can be threaded through the shield segments 131*a* or the shield segments 141*a*.

Figure 7:
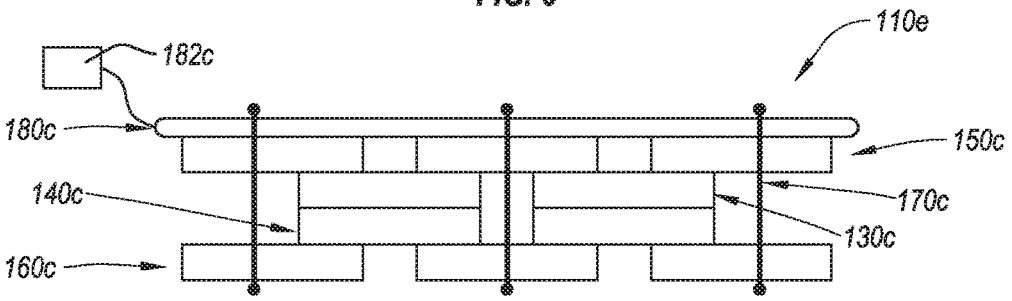
FIG. 7 is a schematic side view of a selectively stiffenable assembly, according to an embodiment.

Generally, the actuator(s) that can reduce or increase the free length of the cable (or increase or decrease the tension of the cable) can vary from one embodiment to the next. FIG. 7 is a schematic side view of a selectively stiffenable assembly 110*e* according to an embodiment. Except as described herein, the selectively stiffenable assembly 110*e* and its elements or components can be similar to or the same as any of the selectively stiffenable assemblies 110, 110*a*, 110*b*, 110*c*, 110*d* (FIGS. 1-6) and their corresponding elements or components. For example, the selectively stiffenable assembly 110*e* can include first stiffenable layer 130*c*, second stiffenable layer 140*c*, first compression layer 150*c*, and second compression layer 160*c* that can be similar to or the same as the first stiffenable layer 130, second stiffenable layer 140, first compression layer 150, second compression layer 160 of the selectively stiffenable assembly 110*b* (FIGS. 4A-4D).

In the illustrated embodiment, the selectively stiffenable assembly 100*d* can include one or more cables 170*c* connecting together the first compression layer 150*c* and second compression layer 160*c*. For example, ends of the cables 170*c* can be tethered or secured to the first compression layer 150*c* at one end and to the second compression layer 160*c* at another, opposing end. Hence, for example, shortening the free length of the cables 170*c* or increasing the tension thereof can force or urge the first compression layer 150*c* and second compression layer 160*c* toward each other, thereby reconfiguring the selectively stiffenable assembly 110*e* from an undeployed configuration to deployed configuration, as described above. In an embodiment, the selectively stiffenable assembly 110*e* can include an expandable element, such as an expandable bag or bladder 180*c* that can shorten the lengths of the cables 170*c* or increase the tension of the cables 170*c*. In an embodiment, the selectively stiffenable assembly 110*e* can include or can be operably coupled to an actuator 182*c* that can operate the bladder 180*c*, as described below (e.g., the actuator 182*c* can be operably coupled to the controller to receive control signals therefrom and can operate the bladder 180*c* responsive to the control signals received from the controller). In an embodiment, the actuator 182*c* can include a pump, compressor, a reservoir of pressurized fluid with controllable fluid release (e.g., with a valve), etc.

For example, the expandable bladder 180*c* can be positioned on an exterior of the first compression layer 150*c* (or second compression layer 160*c*) of the selectively stiffenable assembly 110*d*, and the cables 170*c* can extend through the expandable bladder 180*c*. In an embodiment, expanding a size or thickness of the expandable bladder 180*c* by inflation thereof can position or urge ends of the cable 170*c* away from an exterior surface of the first compression layer 150*c*, thereby shortening the free length of the cables 170*c* or increasing the tension of the cables 170*c*. Generally, the expandable bladder 180*c* can be an inflatable bladder that can be inflated with any number of suitable fluids (e.g., liquids, gases, etc.). In an embodiment, the controller can control or direct flow of one or more fluids into or out of the expandable bladder 180*c* (e.g., responsive to one or more signals received from one or more sensors at the controller). For example, the controller can operate or direct operation of one or more valves that can control fluid flow from a source of fluid into the expandable bladder 180*c*.

In an embodiment, the expandable bladder 180*c* can be positioned adjacent to an outward facing surface of the 150*c* (e.g., away from the surface(s) of the individual) and can absorb some of the impact energy, thereby reducing the force(s) transferred to or experienced by the individual. It should be appreciated, however, that the expandable bladder can be positioned and at any number of suitable locations.

Figure 8:
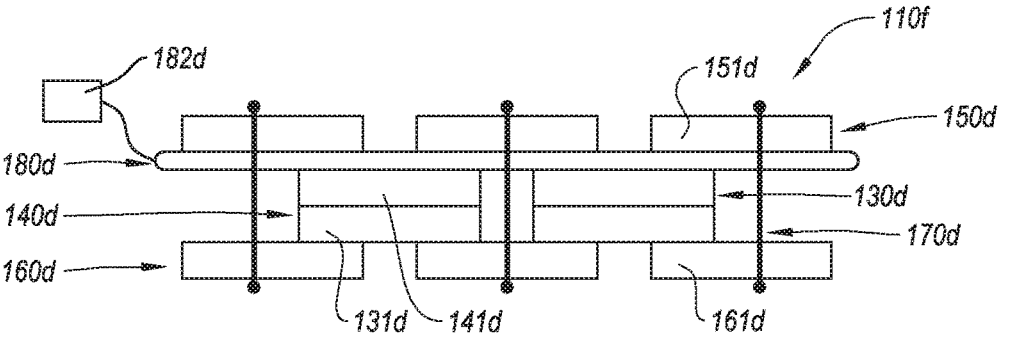
FIG. 8 is a schematic side view of a selectively stiffenable assembly, according to an embodiment.

FIG. 8 is a schematic side view of a selectively stiffenable assembly 110*f* according to an embodiment. Except as described herein, the selectively stiffenable assembly 110*f* and its elements or components can be similar to or the same as any of the selectively stiffenable assemblies 110, 110*a*, 110*b*, 110*c*, 110*d*, 110*e* (FIGS. 1-7) and their corresponding elements or components. For example, the selectively stiffenable assembly 110*f* can include first stiffenable layer 130*d*, second stiffenable layer 140*d*, first compression layer 150*d*, and second compression layer 160*d* that can be similar to or the same as the first stiffenable layer 130, second stiffenable layer 140, first compression layer 150, second compression layer 160 of the selectively stiffenable assembly 110*b* (FIGS. 4A-4D).

For example, the selectively stiffenable assembly 110*f* can include one or more cables 170*d* connecting together the first compression layer 150*d* and the second compression layer 160*d* in a similar manner as the cables 170*c* can connect the first compression layer 150*c* and the second compression layer 160*c* (FIG. 7). For example, the first compression layer 150*d* can include compression elements 151*d* operably connected to the cables 170*d* (e.g., glued, overmolded into plastic compression elements, extending through the compression elements, etc.), the second compression layer 160*d* can include compression elements 161*d* operably connected to the cables 170*d* in a manner that shortening the cables 170*d* or increasing tension in the cables 170*d* can force the compression elements 151*d* toward compression elements 161*d*, thereby compressing together shield segments 131*d* and 141*d* of the respective first and second stiffenable layers 130*d*, 140*d*. In an embodiment, the selectively stiffenable assembly 110*f* can include an expandable bladder 180*d* positioned between the second stiffenable layer 140*d* and first compression layer 150*d*. For example, ends of the cables 170*d* can be tethered or secured to the first compression layer 150*d* at one end and to the second compression layer 160*d* at the opposite end. Hence, for example, moving or urging the first compression layer 150*d* away from the second stiffenable layer 140*d* can increase tension of the cables 170*d* in a manner that compresses together the first stiffenable layer 130*d*, second stiffenable layer 140*d*, and second compression layer 160*d*, thereby reconfiguring the selectively stiffenable assembly 110*f* from undeployed configuration into deployed configuration, as described above.

In an embodiment, the selectively stiffenable assembly 110*f* can include or can be operably coupled to an actuator 182*d* that can operate the bladder 180*d*, as described below (e.g., the actuator 182*d* can be operably coupled to the controller to receive control signals therefrom and can operate the bladder 180*d* responsive to the control signals received from the controller). In an embodiment, the actuator 182*d* can include a pump, compressor, a reservoir of pressurized fluid with controllable fluid release (e.g., with a valve), etc.

Any number of suitable connectors can connect together the compression layers. Moreover, the connectors can include or integrate one or more actuators therein, which can compress together the compression layers, to reconfigure the selectively stiffenable assembly into a deployed configuration. For example, connectors can include rod or fluid operated pistons (e.g., hydraulic or pneumatic) that can urge the compression layers toward each other to reconfigured the selectively stiffenable assembly into deployed configuration or urge the compression layers away from each other to reconfigure the selectively stiffenable assembly into undeployed configuration.

Figure 9A:
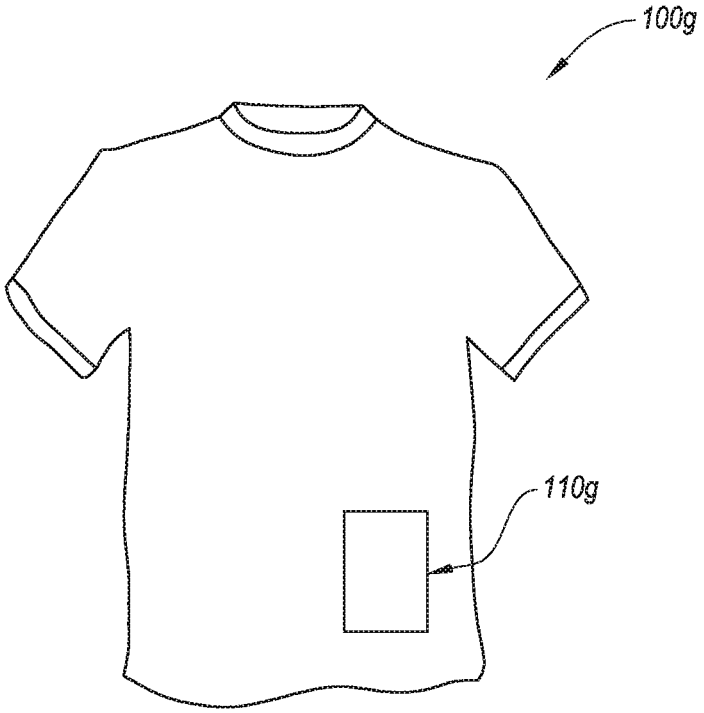
FIGS. 9A-9C are schematic illustrations of different garments that can include any of the protective members disclosed herein, according to different embodiments.
Figure 9B:
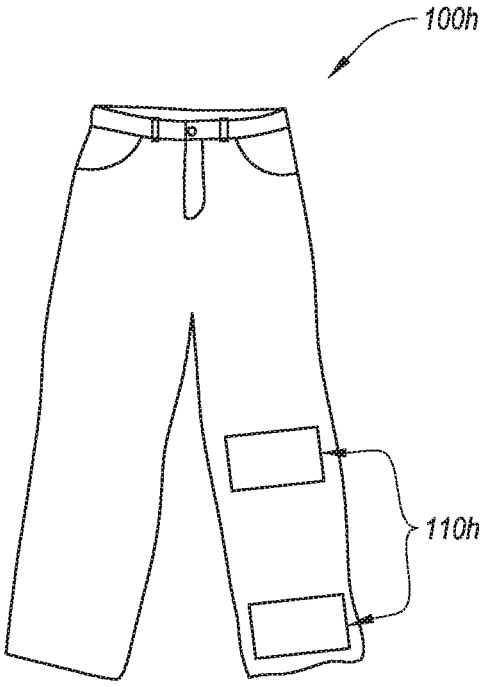
Figure 9C:
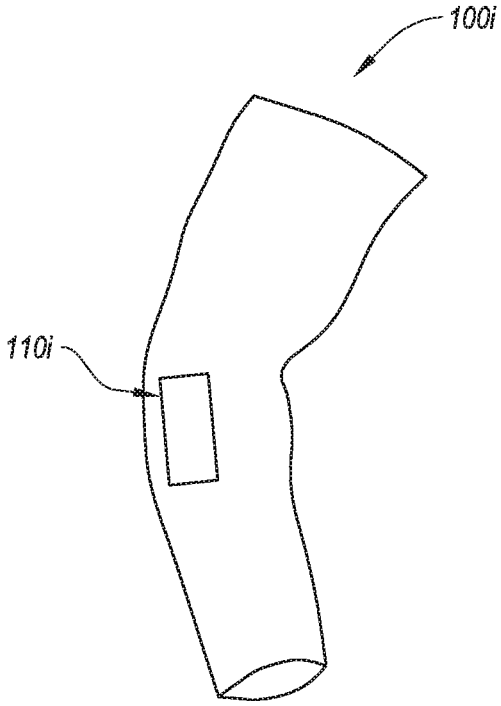

As described above, protective garment(s) can protect any number of body portions of an individual, which can vary from one embodiment to the next. FIGS. 9A-9C are schematic illustrations of protective respective garments 100*g*, 100*u*, 100*g*, according to one or more embodiments. Except as otherwise described herein, the protective garments 100*g*, 100*g*, 100*i* and their respective elements or components can be similar to or the same as any of the protective garments described herein and their respective elements or components.

As shown in FIG. 9A, the protective garment 100*g* can be configured generally in a form of a shirt. The protective garment 100*g* can be configured as a polo shirt, t-shirt, long-sleeved shirt, short sleeved shirt, sleeveless shirt, vest, jersey (e.g., football, baseball, basketball, soccer, hockey, or rugby jersey), sweatshirt, coat, jacket, glove, wrist brace, elbow brace, or any other garment (e.g., outerwear, innerwear) or gear (e.g., rib vest) that at least partially covers an abdominal region, spinal region, back region, thoracic region, shoulder, or arm of an individual. In an embodiment, the protective garment 100*g* can include a selectively stiffenable assembly 110*g* positioned at any number of suitable locations (e.g., near the abdomen portion of the individual, as shown in FIG. 9A). For example, the selectively stiffenable assembly 110*g* can be positioned to at least partially protect at least one of the upper right portion (e.g., right hypochondrium), the upper central portion (e.g., epigastrium), upper left portion (e.g., left hypochondrium), the middle right portion (e.g., right lumber region), the middle central portion (e.g., umbilical region), the middle left portion (e.g., left lumber region), bottom right portion (e.g., right iliac fossa), bottom central portion (e.g., hypogastrium), or the bottom left portion (e.g., left iliac fossa) of the abdominal region.

The selectively stiffenable assembly 110*g* can be positioned to protect at least one of a spleen, colon (e.g., right colon, sigmoid colon, descending colon), left kidney, right kidney, pancreas, liver, gallbladder, small intestine, large intestine, stomach, duodenum, adrenal glands, umbilicus, jejunum, ileum, appendix, cecum, urinary bladder, female reproductive glands, etc. In an embodiment, the selectively stiffenable assembly 110*g* can be positioned to at least partially protect at least one of the right upper quadrant, the left upper quadrant, the right lower quadrant, or the left lower quadrant of the abdominal region. In an embodiment, the selectively stiffenable assembly 110*g* can be positioned to at least partially protect a spine of the individual, such as at least one of the cervical spine (e.g., the shirt includes a collar), thoracic spine, lumbar spine, sacral spine, or tailbone. In an embodiment, the selectively stiffenable assembly 110*g* can be positioned to at least partially protect a chest of an individual, such as at least one of the true ribs, false ribs, floating ribs, sternum, clavicle, the jugular notch, pectoral region, sternal region, etc. In an embodiment, the selectively stiffenable assembly 110*g* can be positioned to at least partially protect a back of the individual, such at least one of lower back, upper back, scapular regions, interscapular region, lumbar region, sacral region, coxal region, inguinal region, gluteal region, etc. In an embodiment, the selectively stiffenable assembly 110*g* can be positioned to at least partially protect an arm of the individual, such as at least one of the shoulder, elbow, wrist, forearm, acromial region, brachial region, cubital region, antebrachial region, carpal region, palmar region, or another portion of the arm. In an embodiment, the selectively stiffenable assembly 110*g* can be positioned to at least partially provide skeletal support to at least one of the abdominal region, spinal region, back region, thoracic region, or arm of the individual.

FIG. 9B is a schematic illustration of the protective garment 100*h* that is configured in the shape of pants that include selectively stiffenable assemblies 110*h*, according to an embodiment. The protective garment 100*h* can be configured as pants or similar garments generally of any suitable length generally covering at least a portion of each of two legs such as full length trousers, shorts (e.g., basketball shorts), capri pants, skirts, dresses, kilts, jeans, leggings, football pants, baseball knickers, hockey pants, rugby trousers, socks, shoes, sandals, knee brace, ankle brace, jockstrap, boxer briefs, or any other garment (e.g., outerwear, innerwear) that at least partially covers at least one of feet, legs, or pelvic region of an individual. For example, one or more of the selectively stiffenable assemblies 110*h* can at least partially protect at least one of toes, arch, heel, ankle, calf, shin, knee, thigh, male reproductive organs, female reproductive organs, lower abdominal region (e.g., iliac fossa), waist, rectal region, pubic region, coxal region, inguinal region, gluteal region, sacral region, lower lumbar region, perineal region, popliteal region, calcaneal region, crural region, tarsal region, dorsum of foot, patellar region, etc. In an embodiment, the selectively stiffenable assemblies 110*h* can be positioned to at least partially provide skeletal support to at least one of the feet, legs, or pelvic region of the individual.

In an embodiment, the protective garment 100 can be configured generally in a form of a single unit of clothing (not illustrated) that substantially covers at least the majority of the torso or the majority of a body of the individual 102. For example, the protective garment can be a jumpsuit, a flight suit, a unitard, a wetsuit, an undergarment (e.g., a union suit), etc. For example, the single unit of clothing can cover all (e.g., have long sleeves or long pant legs) or a portion of the limbs (e.g., have short sleeves or short pant legs). In one example, an undergarment can be worn under additional protective gear, such as protective athletic gear, protective safety gear (e.g., fire protection) or protective environmental gear (e.g., SCUBA gear or a space suit).

FIG. 9C is a schematic illustration of the protective garment 100*i* that is configured in the shape of a sleeve that includes selectively stiffenable assembly 110*i*, according to an embodiment. The protective garment 100*i* can be any item of clothing configured to protect only a single limb of an individual. As such, the selectively stiffenable assembly 110*i* can be positioned to at least partially protect at least one of a wrist, hand, elbow, shoulder, knee, ankle, calf, shin, or another suitable body part. In an embodiment, the selectively stiffenable assembly 110*i* can be positioned to at least partially provide skeletal support to the individual.

Figure 10A:
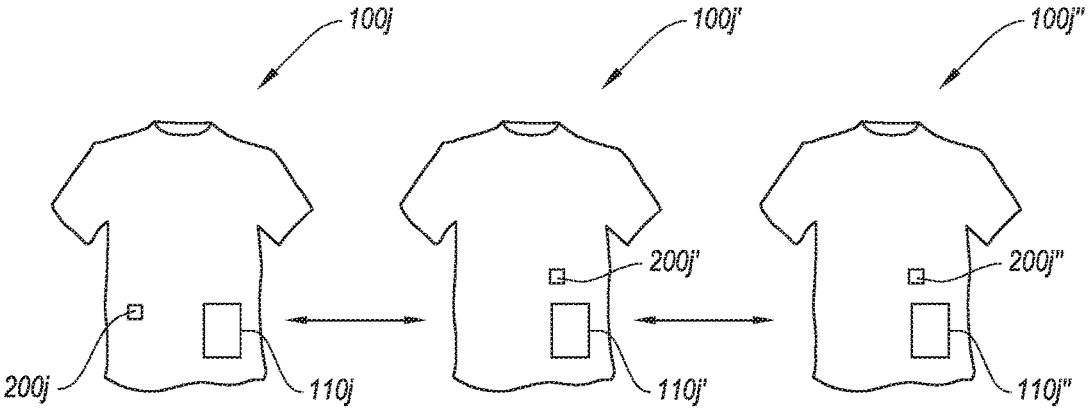
FIG. 10A is a schematic illustration of system that includes a plurality of garments, according to an embodiment.

In an embodiment, a system can include multiple protective garments operably coupled to one or more controllers. FIG. 10A is a schematic illustration of a system that includes a plurality of protective garments 100*j*, 100*j*', 100*j*", according to an embodiment. Any of the protective garments 100*j*, 100*j*', 100*j*" and their respective elements and components can be similar to or the same as any of the protective garments described herein and their corresponding elements and components. For example, each of the protective garments 100*j*, 100*j*', 100*j*" can include a respective selectively stiffenable assembly 100*j*, 110*j*', 110*j*" positioned at any number of suitable locations.

In an embodiment, the protective garments 100*j*, 100*j*', 100*j*" are communicably coupled together. For example, each of the protective garments 100*j*, 100*j*', 100*j*" can include a corresponding controller 200*j*, 200*j*', 200*j*" that can control operation thereof or receive signals from one or more sensors (not shown). The controllers 200*j*, 200*j*', 200*j*" can be operably coupled together or in communication with one another. For example, the controllers 200*j*, 200*j*', 200*j*" transmit information or data to one another (e.g., data or signals from one or more sensors, data or signals related to one or more control signals, such as control signals to reconfigure one or more of the protective garments 100*j*, 100*j*', 100*j*", etc.). In an embodiment, at least one of the protective garments 100*j*, 100*j*', 100*j*" (e.g., one or more of the controllers 200*j*, 200*j*', 200*j*") can include a communication device (e.g., at least one of a receiver or transmitter) that can be integrated with or operably coupled to the corresponding controller of the controllers 200*j*, 200*j*', 200*j*" or can be standalone (e.g., operably to one or more sensors on or near the protected garment).

The protective garments 100*j*, 100*j*', 100*j*" that are communicably coupled together can transmit any number of suitable signals to each other. The signals can include, for example, at least one of location, speed, direction of movement, or acceleration of at least one of the protective garments 100*j*, 100*j*', 100*j*". For example, the signals can include one or more sensing signals, one or more operational instructions, one or more control signals, one or more programs, information from a database, etc. Moreover, the protective garments 100*j*, 100*j*', 100*j*" can be worn by multiple individuals (e.g., the protective garments 100*j*, 100*j*', 100*j*" can be configured as shirts that can be worn by multiple individuals). Additionally or alternatively, the protective garments 100*j*, 100*j*', 100*j*" can be worn by the same individual (e.g., multiple garments that can protect corresponding body portions of the individual).

Figure 10B:
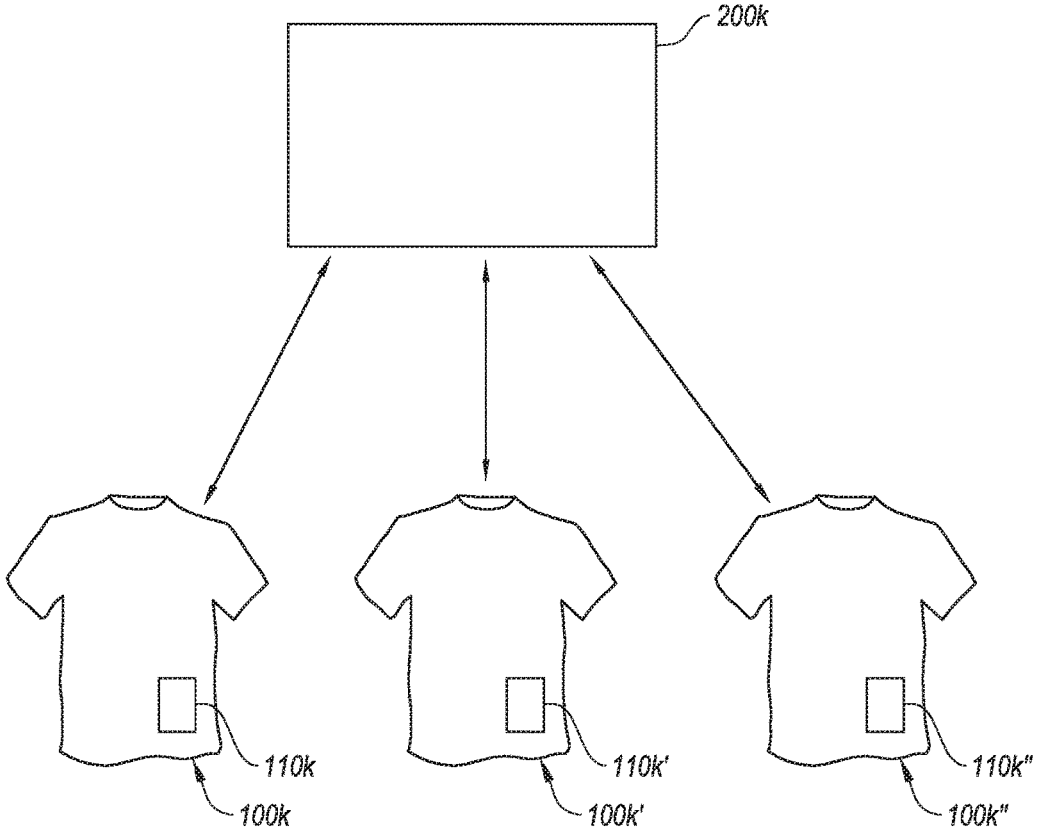
FIG. 10B is a schematic illustration of a system that includes a plurality of garments, according to an embodiment.

In an embodiment, multiple protective garments can be connected to the same controller. FIG. 10B is a schematic illustration of a system that includes a plurality of protective garments 100*k*, 100*k*', 100*k*", according to an embodiment. Any of the protective garments 100*k*, 100*k*', 100*k*" and their respective elements and components can be similar to or the same as any of the protective garments described herein and their corresponding elements and components. For example, each of the protective garments 100*k*, 100*k*', 100*k*" can include respective selectively stiffenable assembly 100*k*, 110*k*', 110*k*" positioned at any number of suitable locations.

In an embodiment, the protective garments 100*k*, 100*k*', 100*k*" can be operably coupled to a controller 200*k* (e.g., the controller 200*k* can be similar to or the same as the controller 200 (FIG. 1B)). For example, the protective garments 100*k*, 100*k*', 100*k*" can be in wireless communication with the controller 200*k*. For example, the controller 200*k* can be configured to at least partially control the operation of the protective garments 100*k*, 100*k*', 100*k*", as described above. For example, the controller 200*k* can be embodied as a central computing unit (CCU). The CCU can be communicably coupled to the protective garments 100*k*, 100*k*', 100*k*". The CCU can include at least one of a laptop, desktop computer, tablet, cellular device, remote control, or another suitable electronic device.

In an embodiment, the controller 200*k* can be configured to output information (e.g., at a user interface) about one or more previous impacts at any of the protective garments 100*k*, 100*k*', 100*k*" or individuals wearing any of the protective garments 100*k*, 100*k*', 100*k*". Additionally or alternatively, the controller 200*k* can be configured to output information related to deployment of the selectively stiffenable assemblies 100*k*, 110*k*', 110*k*". In an embodiment, the controller 200*k* can be configured to output information related to operation or failure of any of the protective garments 100*k*, 100*k*', 100*k*".

In an embodiment, the controller 200*k* can be configured to output one or more recommendations related to safety of an individual wearing at least one of the protective garments 100*k*, 100*k*', 100*k*" (e.g., whether the individual should be moved to a safe location, removed from an athletic event, requires medical attention, etc.). The one or more recommendations can be based at least partially on meeting or exceeding one or more threshold level (e.g., levels related to impact energy imparted onto the individual, number of impacts, alerts received from the individual, etc.). The threshold level can be correlated to a selected likelihood that an individual wearing at least one of the protective garments 100*k*, 100*k*', 100*k*" has been injured from one or more impacts. The controller 200*k* can determine that at least one threshold level has been met or exceeded based on one or more signals received from the sensors.

In an embodiment, the injury threshold level can be a selected likelihood that an actual impact punctured an individual wearing at least one of the protective garments 100*k*, 100*k*', 100*k*". For example, the injury threshold level can be determined based on at least the force of the impact and the radius of curvature of the impact source. In an embodiment, the injury threshold level can be a likelihood that an actual impact broke or fractured a bone of an individual wearing at least one of the protective garments 100*k*, 100*k*', 100*k*". For example, the injury threshold level can be determined based on at least a location on the individual that is impacted and a force applied to the location. In an embodiment, the injury threshold level can be a likelihood that an actual impact damaged a body part (e.g., ruptured spleen, concussion, fractured a joint, contusion, etc.) of an individual wearing at least one of the protective garments 100*k*, 100*k*', 100*k*". For example, the injury threshold level can be determined based on at least a location on the individual that is impacted and a force applied to the location.

The injury threshold level can be when an actual impact has a likelihood of less than 1%, 1%, 2%, 3%, 4%, 5%, 10%, 15%, 20%, 25%, 30%, 35%, 40%, 45%, 50%, 60%, 70%, 75%, 80%, 90%, 95%, or about 100% of causing an injury, including ranges between any of the percentages. In an embodiment, injury threshold level is predetermined and is stored on a memory storage medium (e.g., memory storage medium 202 in FIG. 1B) of the controller 200*k*. In an embodiment, the injury threshold level is determined based on information stored on the memory storage medium. For example, the injury threshold level can be determined at least partially based on an individual's medical history. In an embodiment, the injury threshold level can vary. For example, an impact that can cause a severe injury to an individual can have a lower injury threshold level (e.g., lower likelihood of injury) than an impact that can cause a minor injury. In another example, the injury threshold level can vary based on a time of day, an activity of an individual wearing at least one of the protective garments 100*k*, 100*k*', 100*k*", etc.

In an embodiment, the at least one controller of the garments 100*k*, 100*k*', 100*k*" can be configured to determine whether the injury threshold level has been met or exceeded at least partially based on one or more sensed information signals received by the controller. The garments 100*k*, 100*k*', 100*k*" can include a user interface configured to alert the individual or another entity when the injury threshold level has been met or exceeded. For example, the device can include a speaker that emits a sound when the injury threshold level has been met or exceeded. In such an embodiment, the controller 200*k* can be omitted.

It will be understood that a wide range of hardware, software, firmware, or virtually any combination thereof can be used in the controllers described herein. In one embodiment, several portions of the subject matter described herein can be implemented via Application Specific Integrated Circuits (ASICs), Field Programmable Gate Arrays (FPGAs), digital signal processors (DSPs), or other integrated formats. However, some aspects of the embodiments disclosed herein, in whole or in part, can be equivalently implemented in integrated circuits, as one or more programs running on one or more processors (e.g., as one or more programs running on one or more microprocessors), as firmware, or as virtually any combination thereof. In addition, the reader will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution.

In a general sense, the various embodiments described herein can be implemented, individually and/or collectively, by various types of electro-mechanical systems having a wide range of electrical components such as hardware, software, firmware, or virtually any combination thereof; and a wide range of components that can impart mechanical force or motion such as rigid bodies, spring or torsional bodies, hydraulics, and electro-magnetically actuated devices, or virtually any combination thereof. Consequently, as used herein "electro-mechanical system" includes, but is not limited to, electrical circuitry operably coupled with a transducer (e.g., an actuator, a motor, a piezoelectric crystal, etc.), electrical circuitry having at least one discrete electrical circuit, electrical circuitry having at least one integrated circuit, electrical circuitry having at least one application specific integrated circuit, or a microprocessor configured by a computer program which at least partially carries out processes and/or devices described herein), electrical circuitry forming a memory device (e.g., forms of random access memory), electrical circuitry forming a communications device (e.g., a modem, communications switch, or optical-electrical equipment), and any non-electrical analog thereto, such as optical or other analogs.

In a general sense, the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). The subject matter described herein can be implemented in an analog or digital fashion or some combination thereof.

The herein described components (e.g., steps), devices, and objects and the discussion accompanying them are used as examples for the sake of conceptual clarity. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, the reader can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

In some instances, one or more components can be referred to herein as "configured to." The reader will recognize that "configured to" or "adapted to" are synonymous and can generally encompass active-state components and/or inactive-state components and/or standby-state components, unless context requires otherwise.

While particular aspects of the present subject matter described herein have been shown and described, it will be apparent that, based upon the teachings herein, changes and modifications can be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood that if a specific number of an introduced claim recitation is intended, such an intent will be explicitly recited in the claim, and in the absence of such recitation no such intent is present. For example, as an aid to understanding, the following appended claims can contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense the convention (e.g., "a system having at least one of A, B, or C" would include but not be limited to systems that have A alone, B alone, C alone, A and B together, A and C together, B and C together, and/or A, B, and C together, etc.). Virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, any recited operations therein can generally be performed in any order. Examples of such alternate orderings can include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, the various aspects and embodiments disclosed herein are for purposes of illustration and are not intended to be limiting, with the true scope and spirit being indicated by the following claims.

What is claimed is:

1. A protective garment, comprising:

a plurality of first shield segments forming a first arrangement conformable to one or more contours of an individual wearing the protective garment when the protective garment is in an undeployed configuration;

a plurality of second shield segments laterally offset from the plurality of first shield segments and forming a second arrangement conformable to the one or more contours of the individual wearing the garment when the protective garment is in the undeployed configuration, at least one of the plurality of second shield segments positioned adjacent to at least one of the plurality of first shield segments and two or more shield segments of the plurality of first shield segments overlapping the at least one of the plurality of second shield segments, the plurality of first shield segments being positioned between the one or more contours and the plurality of second shield segments; and a compression mechanism operably coupled to the plurality of first shield segments and to the plurality of second shield segments and configured to compress together at least one of the plurality of first shield segments and at least one of the plurality of second shield segments with the at least one of the plurality of first shield segments being positioned between the individual and the at least one of the plurality of second shield segments when the protective garment is in a deployed configuration, thereby stiffening the protective garment.

2. The protective garment of claim 1, wherein at least one of the plurality of first shield segments or at least one of the plurality of second shield segments have a lateral dimension that is greater than a thickness dimension.

3. The protective garment of claim 1, wherein at least one of the plurality of first shield segments or the plurality of second shield segments include a resilient material.

4. The protective garment of claim 1, further including a first layer material, and the plurality of first shield segments are coupled to the first layer material.

5. The protective garment of claim 2, further including a second layer material, and the plurality of second shield segments are coupled to the second layer material.

6. The protective garment of claim 1, wherein the compression mechanism includes one or more actuators positioned and configured to generate an energy field that compresses together at least one of the plurality of first shield segments and at least one of the plurality of second shield segments.

7. The protective garment of claim 6, wherein the one or more actuators include at least one of: one or more magnetic or one or more electromagnetic elements.

8. The protective garment of claim 6, wherein the one or more actuators are configured to generate the energy field responsive to receiving one or more control signals.

9. The protective garment of claim 8, further including one or more sensors positioned and configured to detect at least one of an impending impact or an actual impact.

10. The protective garment of claim 9, wherein the one or more sensors are operably coupled to control electrical circuitry of a controller.

11. The protective garment of claim 10, wherein the control electrical circuitry is configured to send the one or more control signals to the one or more actuators responsive to the one or more sensors detecting the at least one of the impending impact or the actual impact.

12. The protective garment of claim 7, wherein at least one of the plurality of first shield segments or the plurality of second shield segments are ferromagnetic and configured to interact with the one or more magnetic elements.

13. The protective garment of claim 7, wherein at least one of the plurality of first shield segments or the plurality of second shield segments include ferromagnetic elements that are configured to interact with the one or more magnetic elements.

14. The protective garment of claim 1, wherein at least some of the plurality of first shield segments or at least some of the plurality of second shield segments are coupled together.

15. The protective garment of claim 1, wherein the compression mechanism includes at least one first compression element positioned adjacent to the two or more shield segments of the plurality of first shield segments.

16. The protective garment of claim 15, wherein the compression mechanism includes at least one second compression element positioned adjacent to the at least one of the plurality of second shield segments and operably coupled to the at least one first compression element.

17. The protective garment of claim 16, wherein the compression mechanism includes:

a spindle; and a cable that couples the at least first compression element and the at least second compression element, the cable being operably coupled to the spindle;

wherein the spindle is configured to reduce a free length of the cable to thereby compress together the at least first compression element and the at least second compression element.

18. The protective garment of claim 17, wherein:

the cable is coupled to the spindle; and the spindle includes a fluid-expandable bellows that is configured to reduce the free length of the cable responsive to expansion thereof.

19. The protective garment of claim 18, wherein the compression mechanism includes one or more fluid-carrying tubes operably coupled to the fluid-expandable bellow and configured to supply fluid thereto.

20. The protective garment of claim 19, wherein at least one of the one or more fluid-carrying tubes is positioned between the at least first compression element and the plurality of first shield segments.

21. The protective garment of claim 16, wherein the compression mechanism includes an expandable element positioned and configured to compress together the two or more shield segments of the plurality of first shield segments and the at least one of the plurality of second shield segments.

22. The protective garment of claim 21, wherein the expandable element includes a fluid-inflatable bag.

23. The protective garment of claim 21, wherein:

the at least first compression element and the at least second compression element are operably coupled together; and the expandable element is positioned between the at least first compression element and the plurality of first shield segments.

24. The protective garment of claim 21, wherein:

the at least first compression element and the at least second compression element are operably coupled together; and the expandable element is positioned near an outer surface of the at least first compression element.

25. The protective garment of claim 15, wherein the at least one first compression element includes a plurality of shield segments forming a third arrangement that is different from the first arrangement.

26. The protective garment of claim 15, wherein the at least one first compression element includes at least one continuous sheet.

27. The protective garment of claim 16, wherein the at least one second compression element includes a plurality of shield segments forming a fourth arrangement that is different from the second arrangement.

28. The protective garment of claim 16, wherein the at least one first compression element includes at least one continuous sheet.

29. The protective garment of claim 1, wherein at least one of the at least one first compression element or the at least one second compression element includes a plurality of first compression segments spaced from one another.

30. The protective garment of claim 1, further including a plurality of third shield segments forming a third arrangement and positioned adjacent to the plurality of second shield segments.

31. The protective garment of claim 30, wherein the third arrangement is not operably coupled to the compression mechanism.

32. The protective garment of claim 31, further including a plurality of fourth shield segments forming a fourth arrangement and positioned adjacent to the plurality of third shield segments.

33. The protective garment of claim 32, wherein the fourth arrangement is not operably coupled to the compression mechanism.

34. The protective garment of claim 1, further including one or more sensors positioned and configured to detect at least one of an impending impact or an actual impact.

35. The protective garment of claim 34, wherein the one or more sensors are operably coupled to control electrical circuitry of a controller.

36. The protective garment of claim 35, wherein the control electrical circuitry is configured to send the one or more control signals to the compression mechanism and to direct the compression mechanism to compress together at least one of the plurality of first shield segments and at least one of the plurality of second shield segments.

37. The protective garment of claim 36, wherein the control electrical circuitry is configured to send one or more additional control signals to the compression mechanism and to direct the compression mechanism to release the at least one of the plurality of first shield segments and at least one of the plurality of second shield segments from compression.

38. The protective garment of claim 35, wherein the controller includes an interface configured to communicate with one or more of a user, a computer, a tablet, a cellular device, or a remote control.

39. The protective garment of claim 38, wherein the interface includes a user interface configured to inform at least one of a user or a subject of one or more of previous impacts against the subject, deployment history of the plurality of protective garment, sensed motion characteristics, readiness status of one or more portions of the protective garment system, program instructions, or threshold levels of force applied to the subject.

40. A protective garment system, comprising: a plurality of first shield segments forming a first arrangement conformable to one or more contours of an individual wearing the protective garment when the protective garment is in an undeployed configuration; a plurality of second shield segments forming a second arrangement conformable to the one or more contours of the individual wearing the garment when the protective garment is in the undeployed configuration, at least one of the plurality of second shield segments positioned adjacent to at least one of the plurality of first shield segments and two or more shield segments of the plurality of first shield segments overlapping the at least one of the plurality of second shield segments, the plurality of first shield segments being positioned between the one or more contours and the plurality of second shield segments; a compression mechanism operably coupled to or integrated with at least one of the plurality of first shield segments or the plurality of second shield segments and configured to change sliding resistance therebetween from a first state to a second state; the sliding resistance between the plurality of first shield segments and the plurality of second shield segments being greater in the second state; wherein each shield segment of the plurality of first shield segments has a generally circular first perimeter and a first lateral surface bounded by the generally circular first perimeter; each shield segment of the plurality of second shield segments having a generally circular second perimeter and a second lateral surface bounded by the generally circular second perimeter; and the compression mechanism is configured to change sliding resistance between the first lateral surface of one or more of the plurality of first shield segments and the second lateral surface of one or more of the plurality of second shield segments from a first state to a second state such that both the first lateral surface and the second lateral surface are changed to the second state, the sliding resistance between the one or more of the plurality of first shield segments and the one or more of the plurality of second shield segments being greater in the second state.

41. The protective garment system of claim 40, further including a first layer material, the plurality of first shield segments coupled to the first layer material.

42. The protective garment system of claim 41, further including a second layer material, the plurality of second shield segments coupled to the second layer material.

43. The protective garment system of claim 40, wherein the compression mechanism is configured to compress together at least one of the plurality of first shield segments and at least one of the plurality of second shield segments.

44. The protective garment system of claim 40, wherein the compression mechanism includes at least one first compression element positioned over the two or more shield segments of the plurality of first shield segments.

45. The protective garment system of claim 44, further including a controller having control electrical circuitry.

46. The protective garment system of claim 45, further including one or more sensors operably coupled to the control electrical circuitry of the controller and positioned and configured to detect at least one of an impending impact or an actual impact.

47. The protective garment of claim 46, wherein the compression mechanism includes at least one second compression element positioned over the plurality of second shield segments and the compression mechanism compresses together the at least one first compression element and the at least one second compression element responsive to the one or more control signals generated by the controller.

48. The protective garment of claim 47, wherein the compression mechanism includes:

a spindle; and a cable that couples the at least first compression element and at least a second compression element, the cable being operably coupled to the spindle;

wherein the spindle is configured to reduce a free length of the cable to thereby compress together the at least first compression element and the at least second compression element.

49. The protective garment of claim 1, wherein the compression mechanism is configured to compress the at least one of the plurality of first shield segments directly against the at least one of the plurality of second shield segments when the protective garment is in the deployed configuration.

50. The protective garment of claim 49, wherein:

each shield segment of the plurality of first shield segments has a generally circular first perimeter and a first lateral surface bounded by the generally circular first perimeter;

each shield segment of the plurality of second shield segments has a generally circular second perimeter and a second lateral surface bounded by the generally seconded perimeter; and the compression mechanism is configured to increase a sliding resistance of the first lateral surface of the at least one of the plurality of first shield segments directly against the second lateral surface of the at least one of the plurality of second shield segments when the protective garment is in the deployed configuration relative to the sliding resistance of the first lateral surface of the at least one of the plurality of first shield segments directly against the second lateral surface of the at least one of the plurality of second shield segments when the protective garment is in the undeployed configuration.

* * * * *